US006282842B1

(12) United States Patent
Simens

(10) Patent No.: US 6,282,842 B1
(45) Date of Patent: Sep. 4, 2001

(54) INFLATABLE ROOF SUPPORT SYSTEMS

(76) Inventor: Robert R. Simens, 34525 Sherwood Park Dr., Solon, OH (US) 44139

( * ) Notice: Subject to any disclaimer, the term of this patent is extended or adjusted under 35 U.S.C. 154(b) by 0 days.

(21) Appl. No.: 09/294,532

(22) Filed: Apr. 19, 1999

Related U.S. Application Data

(63) Continuation-in-part of application No. 09/003,846, filed on Jan. 7, 1998, now abandoned, which is a continuation-in-part of application No. 08/594,142, filed on Jan. 31, 1996, now abandoned, which is a continuation-in-part of application No. 08/384,664, filed on Feb. 6, 1995, now abandoned.

(51) Int. Cl.[7] ..... E04H 3/10

(52) U.S. Cl. ..... 52/2.11; 52/6; 52/1; 52/80.1; 52/82

(58) Field of Search ..... 52/2.11–2.13, 2.18, 52/2.22, 2.24, 2.25, 2.26, 6, 80.1, 82; 135/908

(56) References Cited

U.S. PATENT DOCUMENTS

| | | | | |
|---|---|---|---|---|
| 2,850,026 | | 9/1958 | Leatherman . | |
| 3,123,085 | * | 3/1964 | Demarteau | 52/2.11 |
| 3,256,895 | * | 6/1966 | Duquette | 52/2.11 |
| 3,338,000 | | 8/1967 | Ostrander . | |
| 3,643,910 | | 2/1972 | Heifetz . | |
| 4,257,199 | | 3/1981 | Kuboyama . | |
| 4,384,435 | | 5/1983 | Polise . | |
| 4,452,017 | | 6/1984 | Tang . | |
| 4,550,533 | * | 11/1985 | Fraioli | 52/2.25 |
| 4,559,746 | * | 12/1985 | Ishler | 52/2.17 |
| 4,581,860 | * | 4/1986 | Berger | 52/63 |
| 4,805,355 | * | 2/1989 | Plant | 52/1 |
| 4,932,169 | | 6/1990 | Charbonneau . | |
| 4,936,060 | * | 6/1990 | Gelinas et al. | 52/1 |
| 5,371,983 | | 12/1994 | Kawaguchi . | |
| 5,440,840 | | 8/1995 | Levy . | |
| 5,502,928 | | 4/1996 | Terry . | |

* cited by examiner

*Primary Examiner*—Christopher T. Kent
*Assistant Examiner*—Jennifer I. Thissell
(74) *Attorney, Agent, or Firm*—Vincent A. Green

(57) ABSTRACT

A sports stadium or building complex is covered by a huge fiberglass fabric dome that is supported by an inflatable dual-membrane bladder on a hollow compression ring with a diameter of 800 to 1200 feet. A central vertical spreader having upper and lower tension rings connected to the membranes of said bladder is supported from above or below by separate suspension cables in a position above the compression ring. Containment cables limit the expansion of and shape said bladder to provide a closed pressurized air space of narrow lenticular cross section and can include 40 or more radial ceiling cables and the same number of radial hold-down cables of the same length.

26 Claims, 14 Drawing Sheets

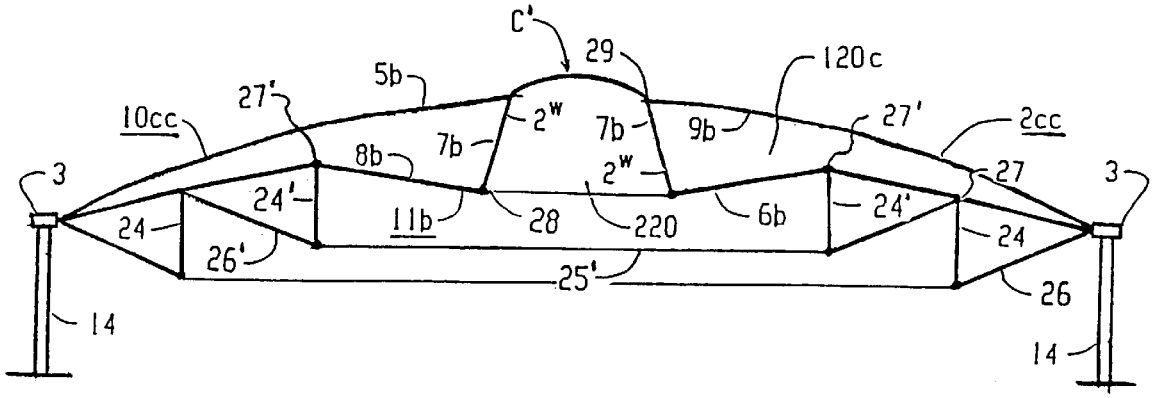
FIG. 4CC
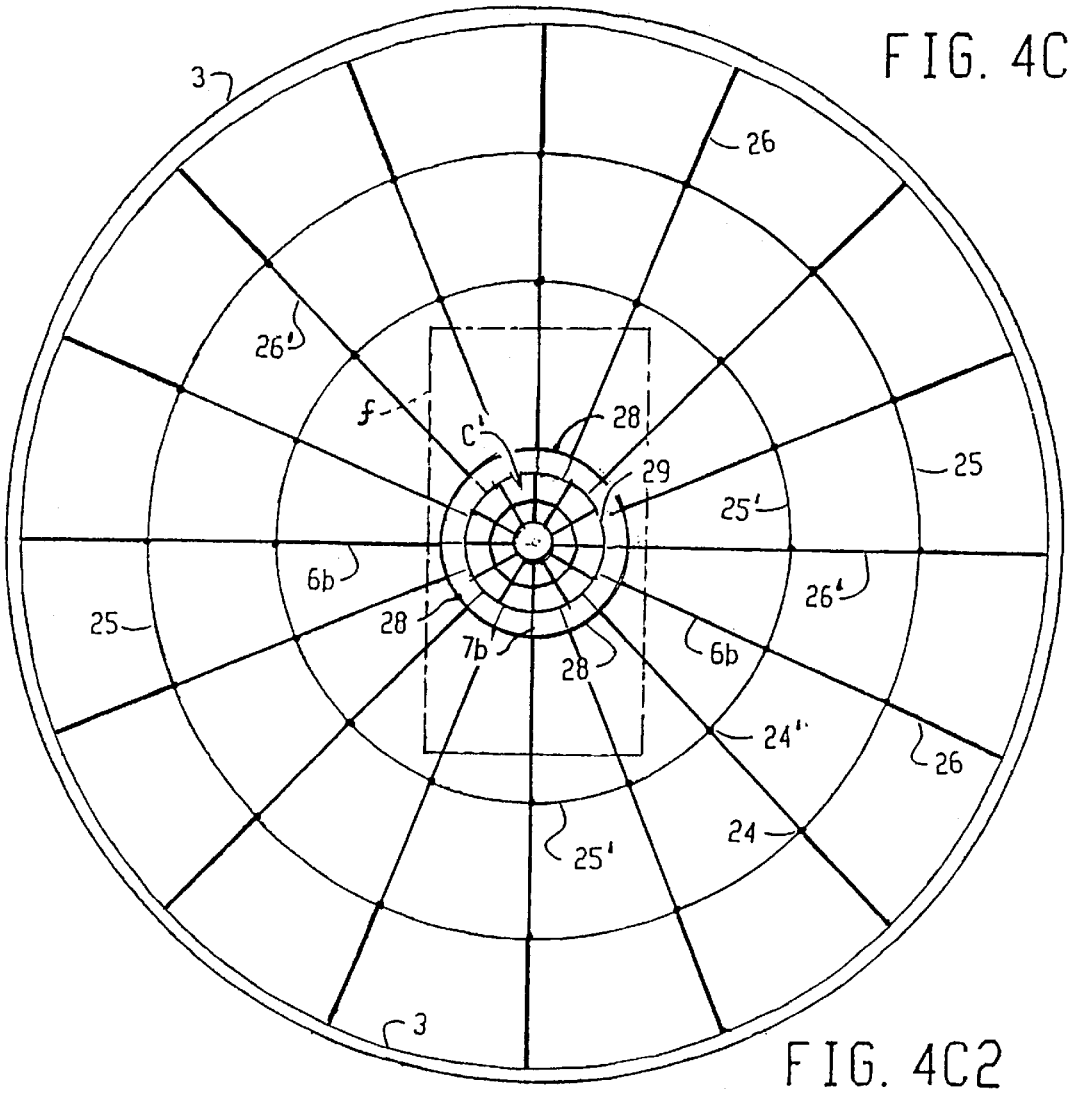
FIG. 4C2

INFLATABLE ROOF SUPPORT SYSTEMS

This application is a continuation-in-part of my application Ser. No. 09/003,846, filed Jan. 7, 1998, now abandoned which is a continuation-in-part of my abandoned application Ser. No. 08/594,142, filed Jan. 31, 1996, which is a continuation-in-part of my abandoned application Ser. No. 08/384,664 filed Feb. 6, 1995.

The present invention relates to inflatable roof structures and more particularly to a method and apparatus for supporting a roof or dome of a convention center, sports arena, stadium or other large building complex in which inflatable bladder means form a closed pressurized air space and are supported by cables or other suspension means below the roof.

One embodiment of the invention relates to a unique convention center, trade center or building complex that includes a sports arena and utilizes the novel roof support system.

BACKGROUND OF THE INVENTION

The use of air pressure to support the roofs of building structures has been well known for several decades as described, for example, in U.S. Pat. Nos. 2,837,101 and 2,850,026. The so-called "air domes" and various air-supported roofs are known or have been used including roof systems that employ inflatable air bags or bladder means.

Such roof systems have been used in inflatable buildings as in U.S. Pat. No. 2,837,101 and in green-houses and mobile or portable buildings as disclosed in U.S. Pat. Nos. 3,338,000; 4,805,355; 4,924,651 and 4,976,074. Inflatable roofs have been proposed for covering airplane hangers using many tubular air bags mounted side by side as in U.S. Pat. Nos. 4,257,199 and 4,976,074, sometimes using helium in the bags to provide buoyancy as in U.S. Pat. No. 2,850,026.

Also shown in the prior art patents are building structures having inflatable bladder means supported on a fixed ceiling between the ceiling and the roof to support the roof by air pressure as disclosed in U.S. Pat. Nos. 2,837,101; 3,057,368; 4,452,017 and 4,805,355. As pointed out in U.S. Pat. No. 3,057,368 (1962) the air-supported dome can be subject to severe wind and snow loads. For these and other reasons, the use of air domes has been limited.

U.S. Pat. Nos. 4,805,355 and 4,924,651 disclose portable inflatable building structures for use as greenhouses wherein relatively large bladder means of lenticular cross sections are mounted on generally horizontal suspension cables to provide an inflatable bubble roof. Neither patent discloses an inflatable roof suitable for covering a sports arena or other large building.

U.S. Pat. No. 4,976,074 discloses an inflatable roof designed for use as an airplane hanger and described as possibly suitable for covering a sports stadium. However, it appears to be unsafe and impractical for a sports arena.

Sports stadiums have been covered by the so-called "air domes" as disclosed in U.S. Pat. No. 3,744,191, for example, wherein a network of crossing cables is employed to provide the needed strength. Large stadiums have also been covered by "cable domes" having a network of crossing cables in the roof and a similar network of suspension cables with rigid upright struts or spreaders to maintain tension in the cables as disclosed 30 years ago in U.S. Pat. No. 3,410,039.

Spaced radial cables have been proposed for reinforcing the roof as in U.S. Pat. No. 3,740,902 but cable networks have been favored by the experts in stadium technology because of added strength, resistance to vibration and other advantages. The roof systems of U.S. Pat. Nos. 3,410,039; 3,772,836; 3,835,599; 3,841,038; 4,452,017; 4,451,860; 5,259,158;5,371,983 and 5,440,840 employ such cable networks.

While air domes and cable domes, such as those previously mentioned, have been known or proposed for use on sports arenas for decades, the number actually used for that purpose has been limited. A decade ago only seven cities in this country had enclosed domed stadiums for professional sports. However, interest in such stadiums has grown rapidly since the mid-1980s.

The first enclosed stadiums used steel or reinforced concrete domes but such roofs were expensive, heavy and difficult to waterproof. The glazing and trusswork of stadiums, such as the Astrodome, also created problems.

Such problems led to a second generation of air-supported fabric-covered stadium roofs, lightweight and inexpensive structures, capable of covering large spans. Such air domes presented a number of serious problems including high annual costs for heat, electricity and maintenance and excessive crowd noise. The continual positive air pressure necessary to support the roof required that the stadiums have revolving doors, air locks for trucks, reinforced elevator shafts, additional fan rooms, and other expensive and inconvenient items.

Other serious problems stemmed from damage to the roof fabric during construction and deflations of the domed roofs after completion caused by malfunctioning or poorly operated mechanical or snow removal systems. The above-mentioned drawbacks and problems and extensive litigation associated with the air-supported domes discouraged further use of such roof systems for professional sports stadiums so that they are rarely used on new stadiums and are perhaps obsolete.

The demise of air domes led to the third generation of enclosed stadiums that have fabric roofs supported, not by air pressure, but by tension cables held taut either by large masts or arches, or by smaller compression struts and a compression ring. The leading experts in the engineering of these cable domes are David Geiger and Horst Berger (See U.S. Pat. Nos. 3,772,836; 3,807,421; 3,841,038; 4,452,848; 4,581,860; 4,736,553 and 4,757,650).

The advantages of the cable domes over the previous air-supported domes were many. The cable domes are more easily insulated. They also can take greater snow loads and demand less exacting maintenance. Their higher cost remain a major drawback, but the elimination of the equipment and details required for pressurization make them superior to the previous air-supported domes.

The annual costs associated with operation and maintenance of a conventional air dome, such as Pontiac's Silverdome, are enormous and usually substantially greater than one million dollars because of the large volumes of air involved, the difficulty in heating and cooling the structure, and the general inefficiency of the system. These problems are magnified when attempting to design large structures with a clear span of 700 feet or more. In recent years there has been no serious interest in using air-supported roof systems for sports stadiums or large building complexes.

It can be difficult and expensive to provide a durable roof structure with a clear span of 800 feet or more because of the great weight to be supported. The weight of the roof limits the practical maximum size for a dome even when the dome is covered with the conventional Teflon-coated fiberglass fabric, as used on the Georgia dome. Prior to the present invention cable-supported stadium domes with a clear span in excess of 900 feet have not been built because of the enormous expense involved. The experts on stadium technology heretofore have failed to provide a satisfactory solution to the problem or to provide a versatile, safe, reliable roof system that is commercially practical for huge building complexes.

SUMMARY OF THE INVENTION

The present invention provides a simple, economical, safe and reliable roof support system for a multi-purpose business or convention center, sports complex, trade center, shopping center or other large building complex. Huge domes with a clear span of 800 to 1200 feet or more can be provided having remarkable ability to withstand high wind and snow loads.

Basic features of the invention, as disclosed in parent application Ser. No. 08/384,664, include a huge compression ring or other compression means, ceiling cable means connected to said ring to form a suspended ceiling covering many acres of land, and a series of regularly-spaced radial hold-down cables arranged somewhat like the spokes of a bicycle wheel. The hold-down cables are closely spaced and are connected between the outer compression ring and a central connecting means or hub means located at the top of the dome.

Inflatable bladder means cover said ceiling and have upper and lower fabric walls or membranes providing a closed pressurized air space between the hold-down cables of the dome and the suspension cables of said ceiling. When the bladder means is normally inflated to maintain tension in the hold-down cables and ceiling cables, the upper and lower fabric membranes are under tension and held taut with their outer marginal portions connected to the compression ring.

The radial hold-down cables limit the expansion of the upper fabric membrane, but the air pressure causes it to expand and bulge in the spaces between the adjacent cables as described in U.S. Pat. No. 3,744,191. The hold-down cables are closely spaced to prevent excessive bulging of the fabric.

As indicated in said parent application Ser. No. 384,644, the cable-supported air domes of the present invention can be used to cover large sports stadiums, such as the Georgia Dome, that seat more than 65,000 people while providing clear spans of greater than 860 feet.

When employing large domes with diameters of 800 to 1200 feet, it is preferable to provide radial suspension cables in the ceiling and to elevate those cables so as to reduce and limit the volume of air in the inflatable bladder means. In the preferred embodiments of the invention, a radial ceiling cable can be aligned with and located directly below each of the radial hold-down cables and rigid strut means or spreader means can be employed to limit the separation of the cables and thereby provide the bladder means with a narrow lenticular or crescent-like cross section (e.g., as shown in FIG. 4, 5, and 11).

For example, a central rigid spreader means may be supported from above or below the dome as by overhead suspension cables or by suspension cables carried by the outer compression ring below the ceiling cables. The hold-down cables and ceiling cables would be connected to the spreader means to provide the inflated bladder means with a narrow cross section and a limited air volume. The cross-sectional length is preferably 10 to 20 times the average cross sectional width of the inflated bladder means in preferred embodiments of the invention, such as those illustrated in FIGS. 4, 4AA, 4C and 11.

The present invention makes it feasible to build extremely large domed-roof structures even in locations where wind or snow pose serious problems. This is very important and can be a great advantage in the construction, improvement or renovation of a large sports stadium, for example, because it permits an addition to or an enlargement of the stadium so that it can be used as a convention center, an exhibition center, and an impressive year-round facility which may generate enough revenue to pay for itself independently of the baseball or football team.

In one preferred embodiment of my invention a perimeter wall is constructed that extends around a new or existing sports stadium and a dome is erected and supported by that wall. If the perimeter wall is constructed around an existing sports facility (See FIGS. 10 and 11) and is outwardly spaced 60 to 90 feet or so from the periphery of that facility, then from one to two million square feet of additional floor space can be created and become available under the dome, assuming that the added space between the existing facility and the new perimeter wall is developed to provide a structure with 8 to 15 or more floors.

The domed roof structure can be huge and capable of covering an area of 8 to 12 acres or more. The unique combination described briefly above with an existing stadium surrounded by a perimeter wall of much larger diameter is cost-effective and enables a large city to provide an impressive convention center and/or trade center combined with a multipurpose entertainment, recreation and sports center. That all-purpose facility, more fully described hereinafter, can be used 300 days per year to provide revenue for the city and is likely to pay for itself in a relatively short period of time while upgrading the city's image.

The invention makes it feasible to provide a huge multi-faceted center and recreation area that includes restaurants, retail stores, hotels, movie theaters and other entertainment facilities, an aquarium, museums, trade centers, exhibition centers or the like and that can be used for political and business conventions, national sports playoffs, basketball, baseball, football, soccer, tennis, olympic games, junior olympics, dog racing, vehicle competitions, track and field events, or the like.

The huge all-purpose facility is also extremely energy efficient and economical to maintain. The new domed stadium technology provides unparalleled economies. Air is encapsulated in a separate inflated roof structure that can be maintained at lower temperatures. New roof designs contemplated by this invention make it possible to provide large domed stadiums with a seating capacity in excess of 60,000 which can withstand wind and snow loads greater than existing domed stadiums. If the dome of this invention employs a special reinforced fabric or an extremely strong fabric, such as a tight-woven fiberglass fabric, it is possible to withstand strong winds or wind gusts of hurricane strength and also high snow loads.

One feature of the present invention is the unique combination of a huge reinforced concrete hollow compression ring and a huge inflatable multi-acre bladder means of narrow cross section that is in communication with the interior of said ring around its outer margin. A typical compression ring is made up of 50 or more box-beam sections that fit together end-to-end to provide an annular air conduit surrounding the dome. Each hollow beam section preferably has a length of 40 to 50 feet and can weigh 200 to 300 tons or more with concrete walls 1 to 3 feet thick and can provide a large room 20 to 30 feet wide, 8 to 10 feet high, and 40 to 50 feet long suitable for a variety of activities.

The huge hollow compression ring has a number of important advantages and permits unique methods of operation. It facilitates rapid heating and cooling of the air in the bladder means and rapid increases in air pressure in emergency situations.

It is preferable to provide an air heater and/or a motor-driven fan means in each section of the hollow compression ring (See FIG. 9) or to provide at least 30 air heaters and at least 30 fans spaced around the ring to. permit rapid heating or rapid pressure increases. A preferred way to maintain the desired air pressure and to facilitate air circulation is to direct the air from such fans radially inwardly at regularly spaced locations and to provide controlled vent means at the top of the dome to permit rapid air flow out of the bladder means when desired.

If, for example, fans delivering air to the interior of the stadium provide 2 to 4 or more air changes per hour, as may sometimes be required in a crowded stadium, the present invention facilitates rapid air changes in the bladder means supporting the dome to effect adequate heating or cooling of the air during cold or hot weather. The large number of fans provides rapid air movement and rapid increases in air pressure when needed.

The dome of this invention can be specially constructed to minimize water pooling problems, which were nearly disastrous in the Georgia Dome. The risks posed by possible deflation of the dome can be minimized or reduced by mounting one or both of the two central tension rings for vertical movement as illustrated hereinafter (FIG. 4D).

In the practice of the present invention the bladder means is preferably supported on simple cable-supported ceilings (such as the ceilings 11*b* and 11*c* of FIGS. 4B and 4C) having radial ceiling cables. However, more complicated ceilings can be employed, such as the rigidified triangulated structures of U.S. Pat. No. 5,440,840 or similar structures as used in the Georgia Dome, for example. The simpler construction is more practical and far superior from a construction point of view because it involves a lesser number of cables, posts and connections and can be erected easier and in a short period of time.

BRIEF DESCRIPTION OF THE DRAWINGS

In the drawings:

FIGS. 4AA and 4BB are schematic elevational views showing modifications of the embodiments shown in FIGS. 4A and 4B;

FIGS. 4CC and 4C2 are schematic elevational and plan views showing a modification of the invention similar to the embodiment of FIG. 4B wherein the central part of the dome can be uncovered;

Figure 1:
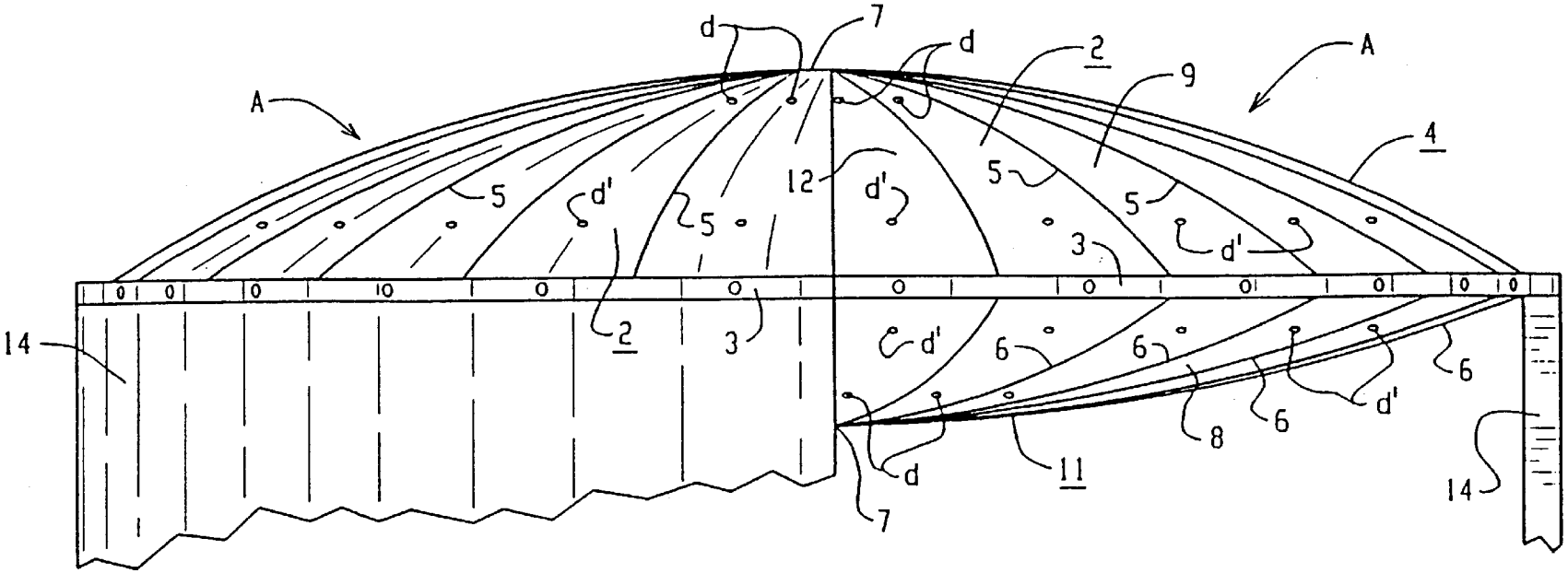
FIG. 1 is a schematic side elevational view on a reduced scale showing the inflated air supporting system of this invention and portions of the stadium on which it is mounted

The roof structures shown schematically in FIGS. 1 to 11 are merely examples to illustrate basic principles of the invention and are not intended to show a domed structure that includes the refinements and improvements likely to be present in a completed facility. While these figures do not attempt to show relative thicknesses of parts or other structural details, they do show the shape, position and relative proportions of basic elements as could be employed in the practice of this invention including a suitable cross section of pressurized air space provided by the inflatable bladder means. To that limited extent, the drawings can be considered to be drawn substantially to scale.

DESCRIPTION OF THE PREFERRED EMBODIMENTS

The present invention provides a method and apparatus for supporting a conventional fabric dome or other roof above a football stadium, convention center, shopping center or other large building complex and is characterized in that inflatable bladder means or the like are provided above the playing field to form a closed air space below the roof and in that air is supplied to the bladder means to maintain an air pressure adequate to support the weight of the roof or to maintain its shape.

The roof support system can be employed to cover a huge building complex and permits economical construction of unique municipal centers and combined sports centers and convention centers as shown, for example in FIG. 10 and described hereinafter.

The inflated support system of my invention is suitable for domed sports stadiums and the like which can be employed on new or existing stadiums or used to replace the air-supported or cable-supported domes of existing stadiums. The basic principles of my invention are illustrated, for example, in the embodiment shown schematically in FIGS. 1 and 2 of the drawings (See also FIG. 11).

As shown a domed air-bag assembly A is provided that includes an inflatable bladder means 2 comprising a two-layer envelope, peripheral compression means comprising a hollow ring 3, and containment cable means comprising a series of evenly spaced radial hold-down cables 5 and a series of evenly spaced radial suspension cables 6 connected to central hubs or tension rings 7. The cables can be spaced apart 5 to 10 degrees or so. The bladder means or envelope 2 comprises imperforate lower and upper woven fabric sheets or membranes 8 and 9, which may be formed of fiberglass or a suitable synthetic plastic. Each of the membranes can be formed of interconnected panels as employed in the Georgia dome, for example.

Figure 3A:
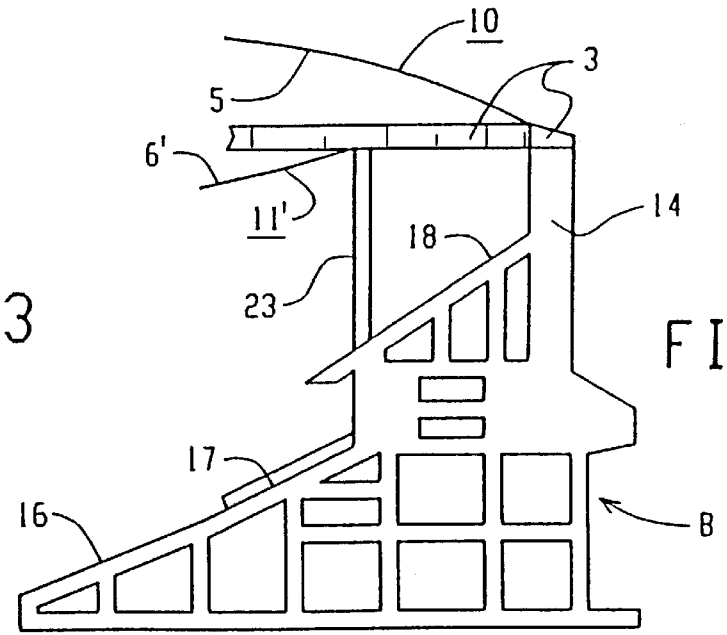
FIGS. 3 and 3A are fragmentary schematic vertical sectional views of a domed stadium on a reduced scale with the radial cables omitted showing the inflated air-supporting mean of the fabric dome.
Figure 3:
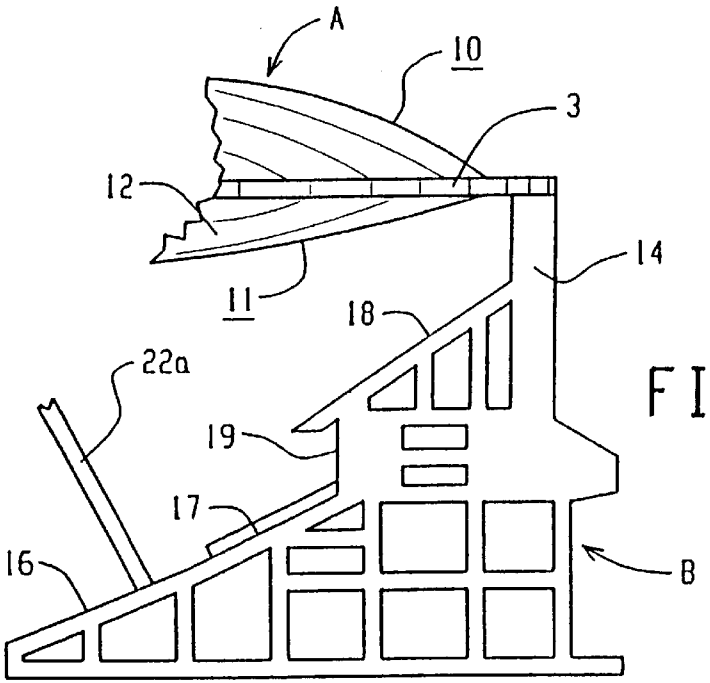

As shown in FIG. 3 a dome or roof 10 is supported by the air pressure in the bladder means 2. The dome 10 is preferably formed of woven fiberglass or a conventional translucent architectural fabric or composite. The fabric sheets 8 and 9 of the dome may, for example, be a conventional architectural fabric made of the same material used in the dome of Atlanta's Georgia Dome—a fiberglass-reinforced, Teflon-coated material approximately one-sixteenth inch thick. Commercial dome fabric of this type is used extensively and sold under the trademark SHEERFILL.

The radial cables 6 provide a ceiling 11 suspended in a fixed position above the playing field. The inflatable bladder means 2 provides a closed pressurized air space 12 between the fabric dome 10 and the suspended cable ceiling 11. This air space is supplied with compressed air and maintained under a regulated pressure by conventional blower means, shown schematically at 130, and/or a series of separate fan means f located in the compression ring as indicated in FIGS. 2, 9 and 10. An air pressure is maintained which is adequate to support the full weight of the dome and to maintain tension in all of the hold-down cables so that the shape of the assembly A and the dome 10 is fixed.

The assembly A and the dome 10 could be used to replace a cable dome, such as is employed on the stadium of the Georgia Dome in Atlanta. This is illustrated schematically in FIG. 3 where the building structure B of that stadium is covered by the assembly A of my invention. That stadium has more than 65,000 seats divided among lower, middle and upper tiers 16, 17 and 18, each with twenty to thirty rows of seats. An executive concourse 19 is provided between the middle and upper tiers.

In the modification of the stadium shown in FIG. 3, a peripheral wall or supporting means 14 extends vertically above building B in alignment with the horizontal compression ring 3 to support the ring around its circumference. The ring is attached throughout its circumference to the marginal portions of the inflated bladder means 2 and to the marginal portions of the fabric sheets 8 and 9 so that they are held taut or under tension when the bladder means is in its normal expanded position as shown in FIG. 1. The compression ring 3 is also attached to the outer ends of a series of regularly spaced hold-down cables 5. These cables can, for example, be arranged radially and spaced apart 5 to 10 degrees or less throughout the circumference of the compression ring. Similarly spaced cables 6 are provided to form a ceiling 11 below the dome to support the inflatable bladder means 2 which is shown as a two-layer composite envelope which provides a closed or sealed air space 12 between the dome and the cable ceiling. In a large dome, the radial cables 5 and 6 could have a length of from 400 to 500 feet.

Figure 1A:
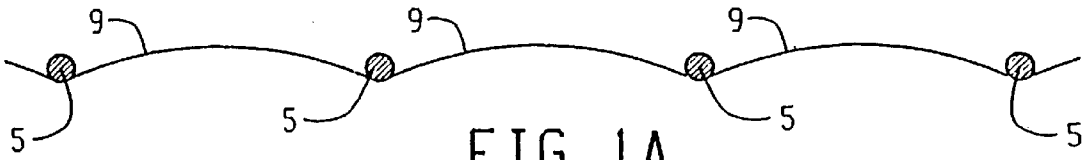
FIG. 1A is a fragmentary schematic sectional view.

When the two-layer airtight bladder is inflated as shown in the drawing, the upper hold-down cables 5 fit against the outside of the dome fabric to hold and protect it (See FIG. 1A). The cables 5 and 6 are not shown in FIGS. 3 and 3A. The cables 5 are preferably interconnected to a central hub member, such as a tension ring 7, located near or below the central portion of the dome. The central tension ring can be of relatively small diameter or, if desired, can have a substantial diameter of 30 to 100 feet or more (See FIGS. 4B, 4D and 4E). A similar central tension ring of small or large diameter can also be used to interconnect the cables 6 forming the ceiling 11 at the bottom surface of the two-layer bladder means 2.

The upper and lower tension rings 7 shown schematically in FIGS. 1 and 2 could have a substantial diameter and would preferably be connected together to limit expansion of the bladder means 2. These rings can be connected by vertical struts or cables or by spreader means comparable to the spreaders 20 of FIGS. 4 and 5, for example.

Figure 7:
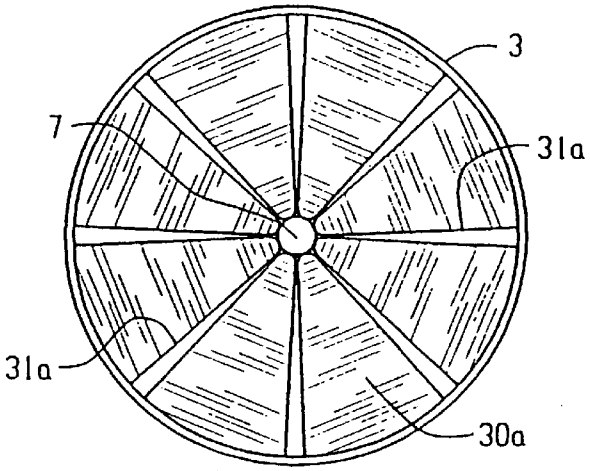
FIGS. 6, 7 and 8 are schematic top views on a reduced scale showing various arrangements of compartmented bladder means or air bag means.
Figure 6:
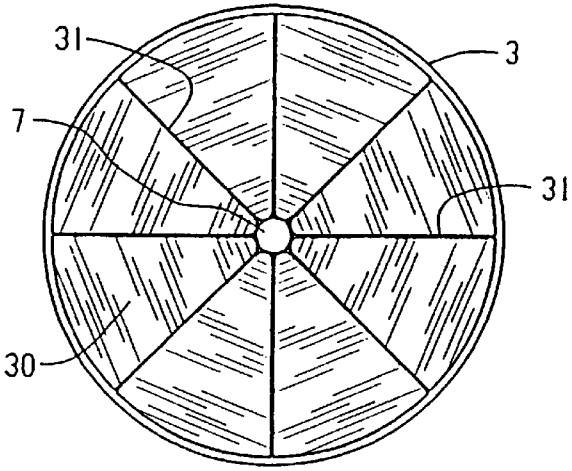
Figure 8:
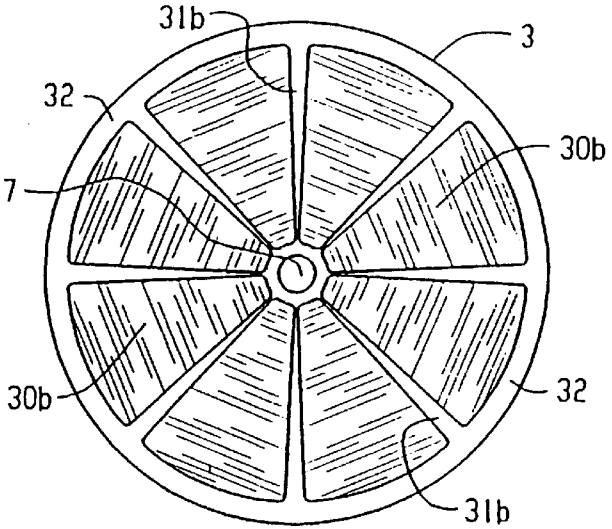

It will be understood that the inflatable bladder means can be designed in different ways and that the closed air space between the dome 10 and the supporting ceiling 11 can be divided into separate compartments, or substantially filled with a number of separate air bags as in the optional structures of FIGS. 6 to 8.

As shown the compression ring connected to the radially outer ends of the upper hold-down cables and the lower suspension cables is in the form of a huge hollow reinforced concrete air conduit 3 and is designed to carry compressed air from the fan means f to the closed air space 12 between the upper and lower membranes of the inflatable bladder means 2. The fans f maintain a controlled or regulated positive air pressure, preferably from 10 to 20 (psf) pounds per square foot, sufficient to expand the bag fully and to support the weight of the dome or roof 10. Sometimes a higher pressure may be employed, such as 30 to 40 psf.

The perimeter of the ring 3 or other compression means can be round, elongated or oval shaped and can have a diameter or width of 500 to 1000 feet or more. The ring can have a uniform cross section throughout its circumference so as to provide an air conduit means extending around the dome providing for rapid or ample air flow into an out of the closed air space 12.

As herein shown, a tensioned fabric dome 10 is provided having an air bag assembly A with hold-down cables 5 that fit against the upper sheet 9 of the bladder means 2. The fabric of the dome can be connected to the ring 3 throughout the periphery of the dome and held taut or under tension in a predetermined position as permitted by the hold-down cables 5. The pressure maintained in the air space 12 is sufficient to maintain tension in each of the cables 5 so that the cables and the dome or shell 10 are maintained in fixed positions.

It will be understood that the ceiling 11 can have various shapes. It can be rigid and generally flat or curved as in FIGS. 4 to 4BB. When using suspension cables 6 as shown, some sagging of the cables is necessary. The degree of sag depends somewhat on the weight of the dome and is exaggerated in FIG. 1 for convenience of illustration. The cables 5 and 6 may have a gentle slope and converge gradually near the compression ring.

Figure 4:
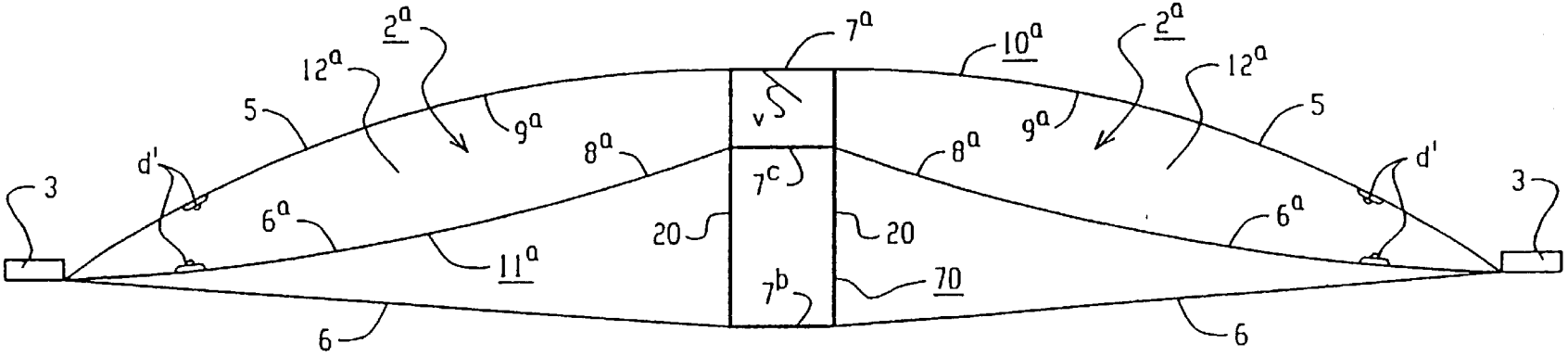
FIG. 4 is a schematic elevational view on a reduced scale showing a modified form with a ceiling supported in an elevated position above the radial suspension cables (6)
Figure 4A:
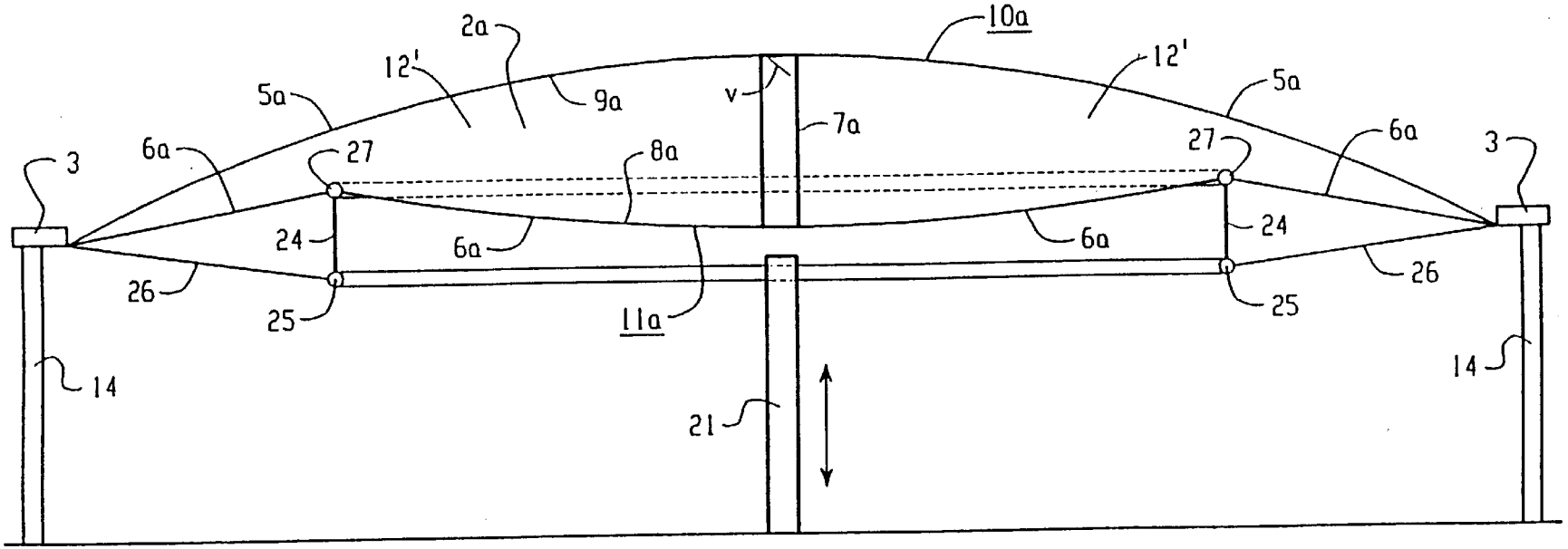
FIGS. 4A and 4B are schematic views similar to FIG. 4 showing modems of the invention.
Figure 4A:
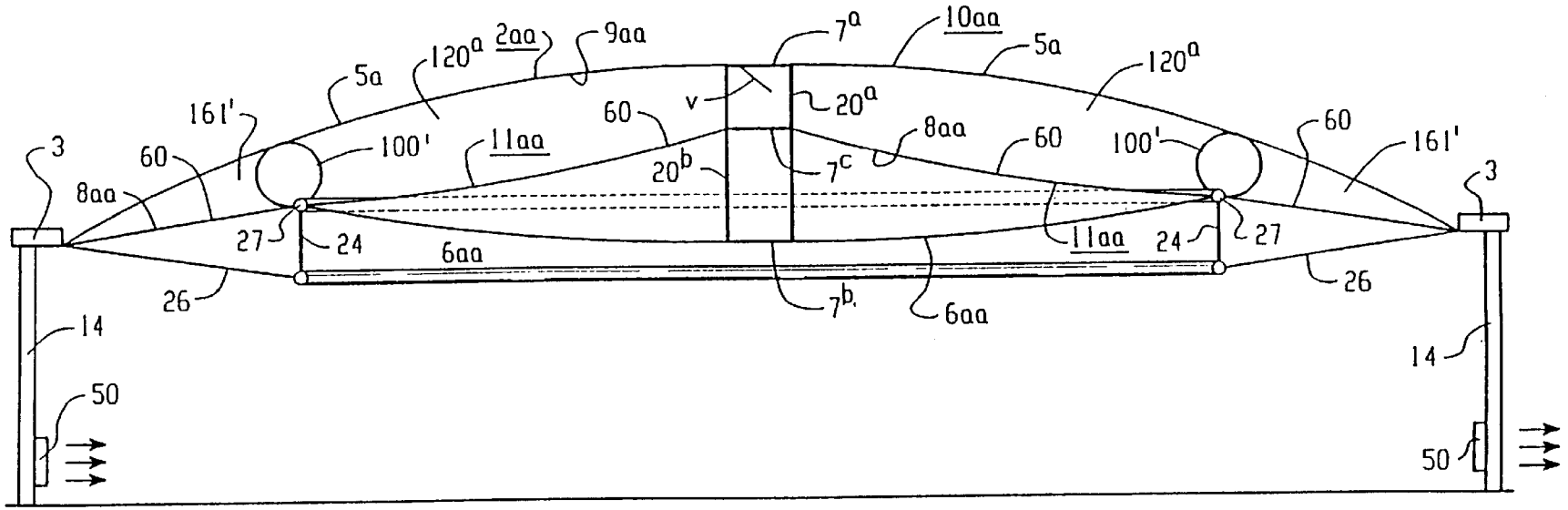
Figure 5:
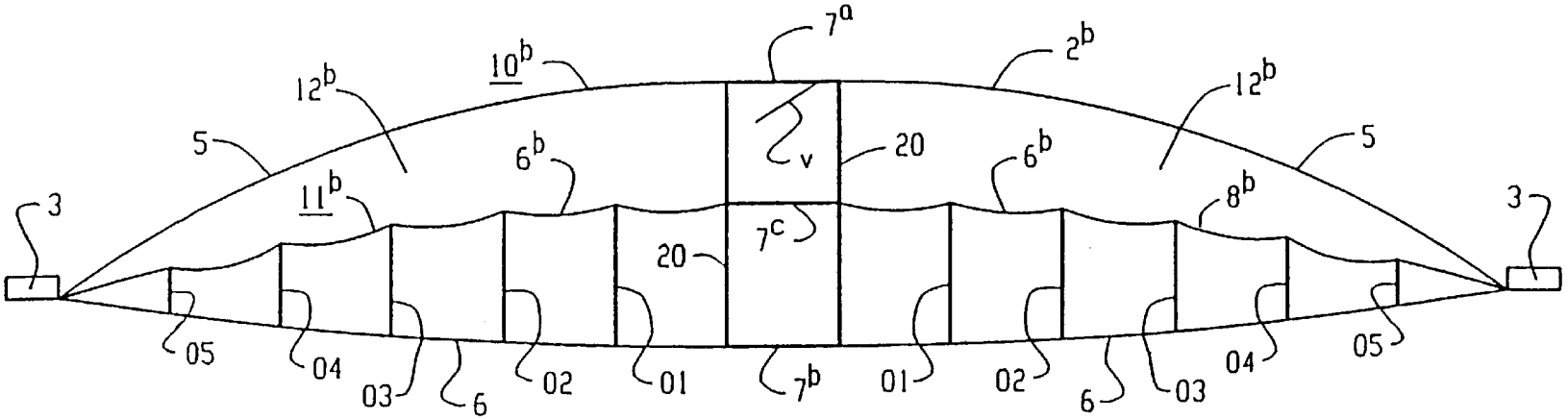
FIG. 5 is a schematic view similar to FIG. 4 showing another modified form.

It is preferable to elevate the ceiling 11 above the suspension cables 6 as by the use of struts, spreaders or vertical supports. Modified forms of the invention with elevated ceilings 11*a* and 11*b* are illustrated in FIGS. 4 and 5 in which the parts corresponding in form or function to similar parts described in said patent application are identified by same numbers, sometimes with suffix letters added. Other modified forms shown in FIGS. 4A, 4AA, 4B, .4BB, 4CC and 11 can be important and are described hereinafter. The elevated ceilings used in the practice of this invention may be triangulated structures of the type disclosed in U.S. Pat. No. 5,440,840.

In the embodiment of the invention shown in FIG. 4, the dome $\mathbf{10}^a$ is supported by 30 to 70 or more radial suspension cables 6 connected between the hollow compression ring 3 and the lower tension ring $\mathbf{7}^b$. A series of circumferentially spaced parallel vertical spreaders or supports 20 are provided to support similar tension rings $\mathbf{7}^a$ and $\mathbf{7}^c$ associated with the upper set of radial containment cables 5 and the intermediate set of radial support cables $\mathbf{6}^a$, each of which may be in vertical alignment with an upper cable 5 and a lower cable 6 as in FIG. 4. The cables are evenly spaced as shown in FIG. 2 with each cable spaced 5 to 10 degrees from the next adjacent cable.

From 30 to 70 or more support cables $\mathbf{6}^a$ may be provided to form an elevated ceiling $\mathbf{11}^a$ covered by the fabric $\mathbf{8}^a$ of the air bag or bladder means $\mathbf{2}^a$. The pressurized air in the closed air space $\mathbf{12}^a$ of the air bag supports the fabric dome $\mathbf{10}^a$ and maintains the cables 5 under tension.

In the embodiment of the invention shown in FIG. 5, a similar arrangement is provided to support the tension rings $\mathbf{7}^a$ and $\mathbf{7}^c$ above the lower hoop or ring $\mathbf{7}^b$ and to provide the desired elevated ceiling, but the fabric-covered ceiling 11*b* in FIG. 5 can be generally flat or slightly convex, if desired, because of the support provided by a multitude of vertical spreaders 01 to 05.

The air bag or bladder means $\mathbf{2}^b$ of FIG. 5 is inflated to apply pressure to the upper radial cables 5 of the dome $\mathbf{10}^b$ and the multitude of intermediate radial support cables $\mathbf{6}^b$ resting on the vertical spreaders 01 to 05. A controlled positive air pressure is maintained in the air space $\mathbf{12}^b$. The number of intermediate support cables $\mathbf{6}^b$ can be from 60 to 90 or more, if desired, and can be the same as the number of upper and lower cables 5 and 6 with each intermediate cable in the same vertical plane as the corresponding cables 5 and 6. In each such vertical plane the cables 5, 6 and $\mathbf{6}^b$ and the spreaders 01 to 05 could be arranged in the same way as shown in FIG. 5.

While the roof support system of the present invention is particularly well suited for spanning large playing fields in sports stadiums and can be cost-effective with clear spans of 1000 feet or more, it will be understood that the cost of construction can be reduced when vertical supporting posts are tolerable or appropriate for the intended usage. Various types of masts, posts or stanchions can sometimes be used to advantage as shown, for example, in FIG. 3 (inclined posts or masts 22*a*), FIG. 3A (posts 23), FIG. 4A (mast 21) and FIG. 4B (masts 22). Vertical posts could, for example, be employed directly below some of the struts or spreaders 01 to 05 of FIG. 5 to help support the cables $\mathbf{6}^b$. A tall central tower or lengthy vertical central mast comparable to the post 21 of FIG. 4A is appropriate in some building complexes as primary support for the central portion of the dome.

It will be understood that the inflatable air bags or bladder means employed in the practice of my invention may be modified in various ways and may contain auxiliary supporting means. The air space $\mathbf{12}^b$ of the bladder means $\mathbf{2}^b$ of FIG. 5 may, for example, contain a number of gas balloons, air bags or air pillows and/or vertical supports or vertical air columns. The bladder means may be divided or separated to provide individual compartments and the walls of the bags or the compartments may incorporate reinforcing cords or the like to limit expansion or to maintain the desired shape.

FIGS. 6, 7 and 8 illustrate modified forms wherein the fabric dome is supported from the suspension cables 6 (or the intermediate support cables 6*a* or 6*b*) by eight separate triangular or pie-shaped air bags of the same size.

FIG. 6 shows the eight individual triangular bags 30 fitting together and extending from the hoop or tension ring (7) to the main outer compression ring 3 with the flat vertical walls in engagement at 31.

FIG. 7 shows a similar arrangement wherein the flat vertical walls of the air bags 30*a* are spaced apart, perhaps five degrees or more, to provide a narrow space at 31*a* that facilitates transmission of light to the playing field or the interior of the building.

FIG. 8 shows a somewhat similar arrangement of eight triangular air bags 30*b* which are spaced from the main compression ring 3 to provide a peripheral space 32 in addition to the radial spaces 31*b* to facilitate transmission of light. These spaces provide windows to admit light and may be covered at the top of the dome (10) with clear plastic or glass sheets.

In the embodiments of the invention shown in FIGS. 6 to 8, six to twelve individual wedge-shaped, deltoid or generally triangular air bags of the same or similar size and shape can provide adequate support for the dome (10). Such air bags are advantageous because they can be handled conveniently during construction of the domed roof and can be repaired or replaced easily. The use of a substantial number of individual air bags can be advantageous in the construction of huge air domes having a clear span of 800 to 1000 feet or more as may be employed to enclose and cover an existing sports stadium or arena.

The hollow compression ring 3 can be a massive reinforced concrete structure. The wall or supporting means 14 required to carry the weight of a very large dome would necessarily be quite substantial. A high peripheral wall could involve major expense. That is obviously different from what was illustrated for convenience in FIG. 3. The concrete compression ring can be supported by regularly spaced columns as in FIG. 11.

While a concrete compression ring is often favored, other peripheral compression means are also suitable for use in the domed roof structures of the present invention. Triangulated bridge-type structures formed of steel or aluminum alloys are sometimes feasible. A triangulated metal compression means could, for example, be part of the roof in a structure similar to that described in U.S. Pat. No. 5,502,928.

It will be understood that modifications and improvements in the basic combination illustrated for convenience in FIGS. 1 and 2 can be very important and that changes may be appropriate, desirable or necessary depending on the particular application and the size or shape of the domed roof.

FIG. 3A shows a modification of the structure shown in FIG. 3 wherein a series of vertical posts 23 are located at the upper tier 18 of the stadium B parallel to the supporting means 14 to support the ceiling 11' and its 70 or more radial cables 6' carried by the main compression ring 3. The dome 10 and its radial cables 5 can be the same as in the structure of FIG. 3.

Figure 4B:
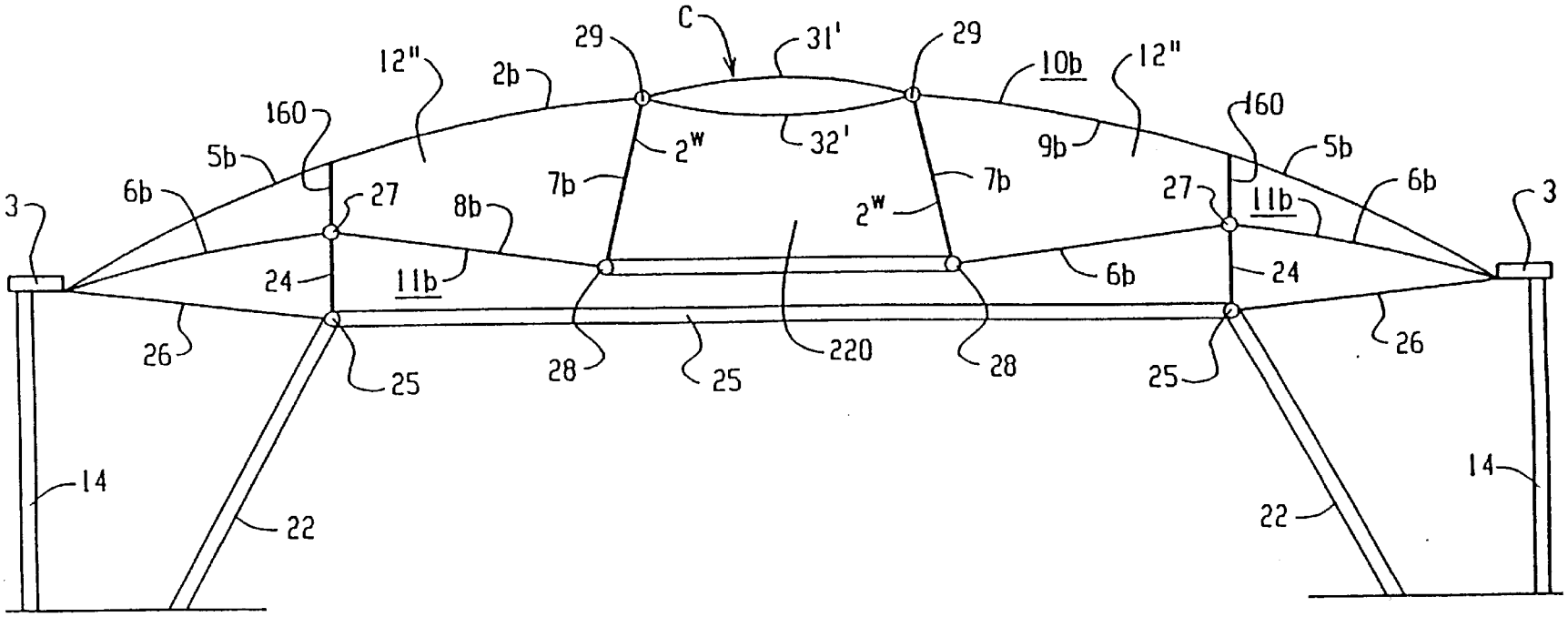
Figure 4B:
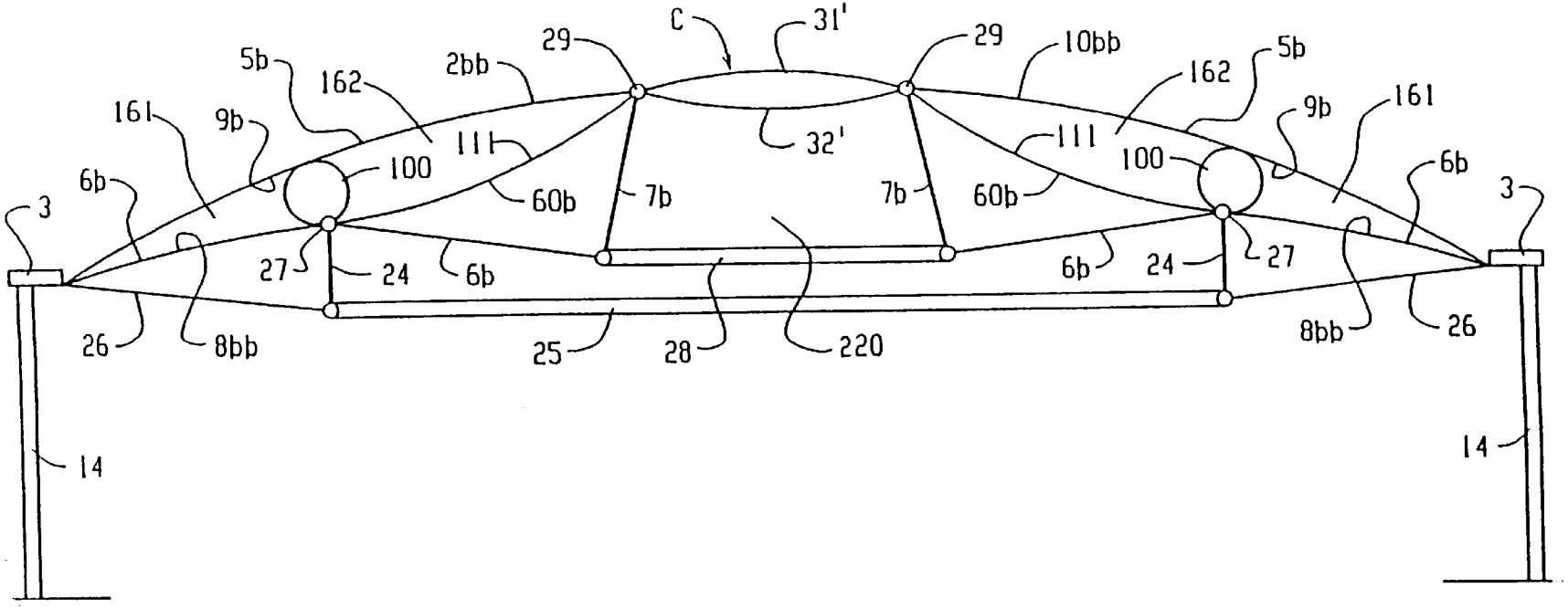

FIGS. 4A and 4B show modifications of the structure shown in FIG. 4 which include features that can be important or desirable. FIG. 4 is a schematic view showing the lenticular cross section of the dome 10*a* at each the 30 to 70 or more more vertical planes that contain the vertically aligned radial cables 5 and 6. FIG. 4A shows a similar dome 10*a* of the same diameter which has been modified to raise the ceiling (11) formed by the radial cables while eliminating the cables 6. The latter cables are replaced by a multitude of short radial suspension cables 26 connected to the main ring 3 and a large circular tension ring or cable 25.

Fifty to seventy or more radial cables 26 could be evenly spaced and located in vertical alignment with an equal number of similarly spaced cables 6*a* forming the ceiling and cables 5*a* forming the dome 10*a*. FIG. 4A, like FIGS. 4, 4AA, 4B, 4BB, 4C and 4CC, is a schematic representation of the cross section at all of the 50 to 70 or more vertical planes containing the vertical axis of the circular dome.

As shown in FIG. 4A, the ceiling (corresponding to ceiling 11) is formed by radial suspension cables 6a which are connected to a rigid central vertical spreader means 7*a* similar to that of FIG. 4 and which extend outwardly to the main ring 3. The ceiling is elevated by rigid vertical struts or poles 24 connected between tension ring 25 and an upper circular ring 27. The inflatable bladder means 2*a* surrounds the spreader 7*a* with its lower wall or membrane 8*a* engaging the cables 6*a* and its upper wall 9*a* engaging the cables 5*a*, thus providing a huge pressurized air space 12' around the tube.

Optionally redundant support may be provided to help support the cables 6 or 6*a* and the dome, such as a removable or retractable vertical mast or post 21 at the center or a series of circumferentially spaced masts or posts 22 or 22*a* of the type shown in FIG. 3 or FIG. 4B. The mast 21 could be stored underground during a football game and thereafter raised to an operative supporting position in engagement with the rigid tube 7*a*. When the mast or support 21 is a fixed permanent element of the roof system, then the suspension cables, such as cables 6 or 6*a*, could be omitted.

FIG. 4B shows another modified form with the ceiling raised by the struts 24 as in FIG. 4A. For convenience of illustration, inclined posts or masts 22 are shown to help support the tension ring 25 and the ceiling cables 6*b*. Such redundant support may sometimes be desirable, but it may be better to have direct support of the ceiling cables as by extending the posts or masts (22) from the ground to the ring 27, thereby eliminating some or all of the struts 24 and/or the elements 25 and 26. For example, the optional posts or masts 22*a* would engage the suspension cables 6 of the ceiling 11 in the structure of FIG. 3 to elevate the ceiling as in FIG. 4A (See also FIG. 3A, post 23).

The convertible dome 10*b* of FIG. 4B is quite different from the dome 10*aa* of FIG. 4AA in that it has a circular (or elongated) central opening 220 to admit light to the playing field and a removable cover or lid C to close the opening. As shown the radial ceiling cables or suspension cables 6*b*, which are sometimes spaced about 5 degrees apart throughout the circumference of the dome, are connected between a central tension ring or cable 28 and the main ring 3 and support an annular inflatable bladder means 2*b* below the radial containment cables 5*b*. A large number of circumferentially spaced upright struts or spreaders 7*b* extend between the lower tension ring 28 and a similar upper tension ring 29 that can be connected to the 50 or more hold-down cables 5*b*. The upright struts 7*b* and optional adjacent cables (not shown) limit inward expansion of the annular inner wall $2^w$ of the bladder means 2*b* and allow the annular air space 12" between membranes 8*b* and 9*b* to be pressurized so that the cables 5*b* and 6*b* are maintained under the desired tension.

The removable cover or lid C may be of rigid or semi-rigid lightweight construction with clear or translucent panes or panels formed of glass or synthetic plastic (See FIG. 4CC) or may be an inflatable air bag or bladder means of lenticular cross section similar to those previously described and having upper and lower ropes or cables 31" and 32" to limit the expansion. An airtight loose-woven or open-net fabric may be employed to form the membranes of the envelope and to improve light transmission through the cover.

FIG. 4BB is a schematic elevational view showing an improvement in the embodiment of FIG. 4B wherein thirty to seventy or more radial cables $60^b$ are connected between the tension rings 27 and 29 to form an inclined bladder means 2*bb* that fits between and fills the space between the fabric 8*bb* of ceiling 111 and the dome fabric 9*b* to maintain tension in the cables 5*b*, 6*b* and 60*b*.

The lid or cover C and the other elements of the structure shown in FIG. 4BB can be the same as shown in FIG. 4B. Optionally an annular flexible tube 100 can be employed with an average diameter about the same as the tension ring 27. That tube when expanded under pressure would maintain the cables 5*b* under tension and help to rigidify the dome during wind storms. That tube could be designed to receive air under a substantial pressure. The optional tube 100 is located between the walls or membranes 8*bb* and 9*b* of the inflatable bladder means and can be integrally attached to them to form separate sealed annular air compartments 161 and 162. Optionally, during windstorms, the pressure in the radially outer compartment 161 could be increased to 30 to 60 psf or more. The air pressure in the cover C could also be increased.

It is advantageous to provide a large central opening in the domed roof of this invention directly above the playing field that can be uncovered during a sports event. The opening preferably has a diameter or width of 100 to 200 feet or more and is sometimes tapered like the opening 220 of FIG. 4B. A favored type of convertible dome is illustrated in FIG. 4CC, for example, and has an inflatable bladder means 2*cc* with an inner peripheral wall $2^w$ providing a white frusto-conical lantern that functions like a lamp shade to facilitate indirect illumination of the playing field.

Figure 4C:
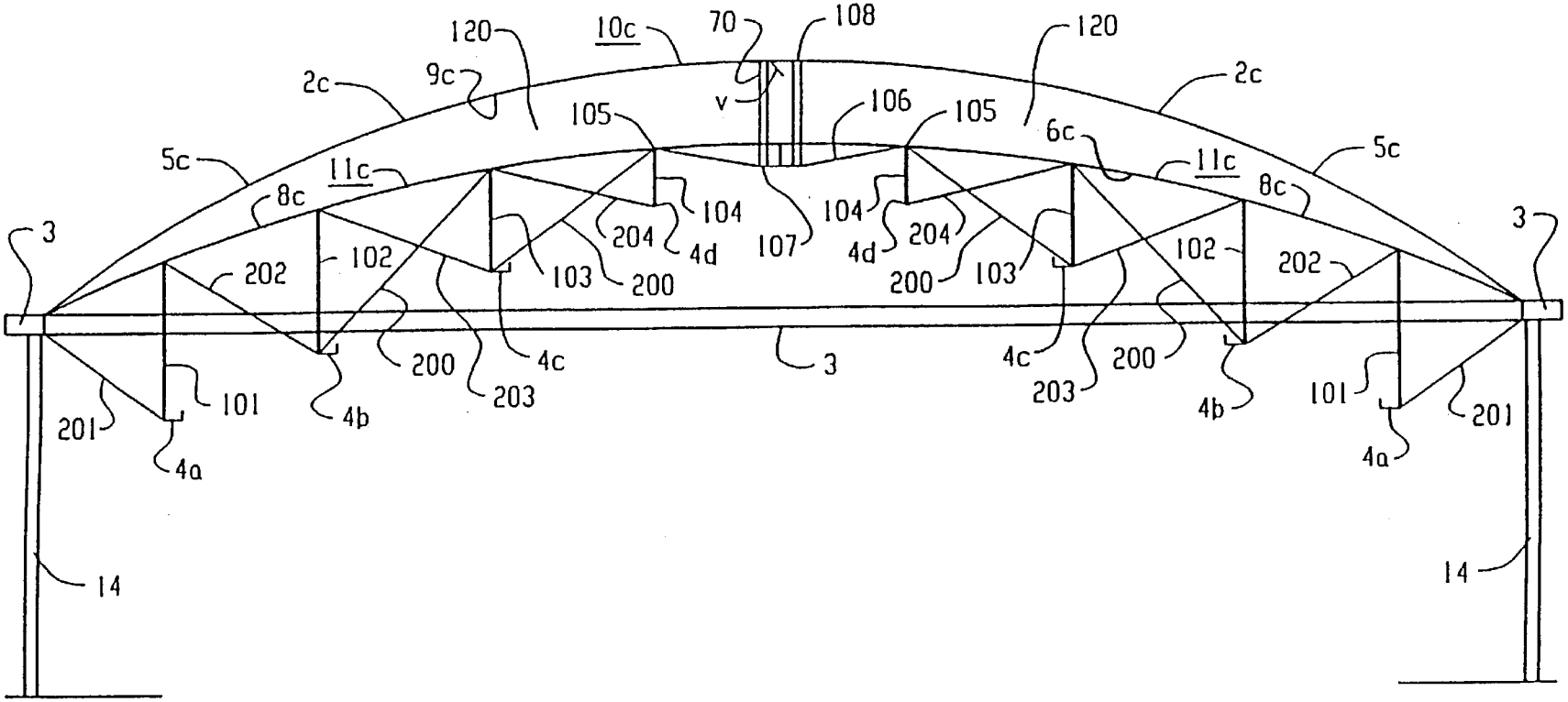
FIG. 4C is a schematic elevational view showing another modification of the invention.

The frusto-conical lantern ($2^w$) illustrated in the embodiments of FIGS. 4B and 4CC is an important feature of this invention and can have a relatively large diameter. As previously indicated, the schematic drawings of this case show relative proportions and indicate that the diameter of the compression ring 3 can be several times (e. g. , 4 to 6 times) the maximum diameter of the lantern at ring 28 and that the ring 29 can have a diameter that is substantially less (e. g. , up to about one-third less). In the embodiment shown in FIGS. 4CC, for example, the tension ring 28 can have a diameter of 140 to 160 feet approaching the width of the football field f and the tension ring 25' can have a diameter of around 400 feet, somewhat greater than the corner to cornerdimension of the field. The tapered opening 220 can admit an adequate amount of sunlight even when the diameter of the upper tension ring 29 is only 100 to 120 feet.

The embodiment of the invention shown schematically in FIG. 4CC corresponds to that of FIG. 4B and is substantially equivalent. except for the additional elements 24', 25', 26' and 27'. FIG. 4C2 is a plan view looking up from the football field to the underside of the dome. The supporting structure for the dome has a pleasing appearance comparable to that provided by the domed baseball stadium built in St. Petersburg in 1989.

As shown, the dome 10*cc* is supported by bladder means 2*cc* having lower and upper fabric membranes 8*b* and 9*b* extending outwardly from the frusto-conical lantern 2$^{w}$ to the outer ring 3. The lantern is bounded by a series of inclined struts 7*b* extending between the central lower tension ring 28 and the central upper ring 29. Radial hold-down cables 5*b* and similarly spaced radial ceiling cables 6*b* extend from the central tension rings to the outer ring 3 and engage the upper and lower membranes of the bladder means 2*cc*. Struts 24 and 24' support the ceiling cables to provide a raised or elevated ceiling 11*b* and to provide the bladder means with a generally lenticular cross section (at chamber 120*c*).

In the embodiment of FIG. 4CC, horizontal tension rings 25 and 25' are supported by short inclined suspension cables 26 and 26', respectively. Each ceiling cable 6*b* is raised by a pair of vertical rigid struts 24 and 24' that support upper rings 27 and 27', respectively. These struts function like the struts 101 and 102 of FIG. 4C to provide the ceiling 11*b* with the desired shape.

The inverted plan view of FIG. 4C2 and the schematic elevational view of FIG. 4CC are drawn substantially to scale to provide a practical illustrative example and to facilitate an understanding of the invention. The dome 10*cc* can have a width or diameter of 800 feet or more and can be circular or elongated (e. g. , as in the Georgia Dome). The upper membrane 9*b* of the inflatable bladder means 2*cc* would preferably be formed of interconnected fiberglass fabric panels, perhaps similar to those used in the Georgia Dome and shown described in the Mar. 16, 1992, issue of "Engineering News-Record" (The McGraw-Hill Construction Weekly).

Figure 5B:
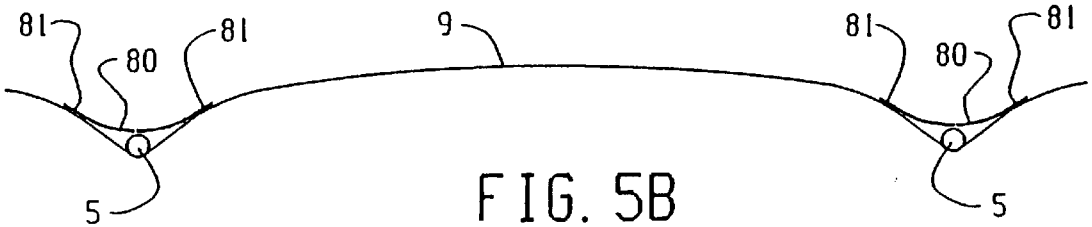
FIGS. 5A and 5B are schematic top and sectional views showing a modified form wherein the hold-down cables are covered by fabric strips.

The fiberglass fabric is strong enough to support a small truck but will deform and bulge outwardly between the radial hold-down cables (5*b*) as indicated, for example, in FIGS. 1A and 5B. The air pressure in the closed chamber 120*c* between the huge fabric membranes 8*b* and 9*b*, which is usually 15 psf or more, will cause the fiberglass fabric to be held taut in a desired position, such as that indicated in FIG. 4CC.

The rigid upright struts 7*b* of the spreader means at the lantern 2$^{w}$ limit the vertical separation of the ceiling 11*b* and the upper ring 29 to limit the volume of air in the air space 120*c*. optionally, similar struts of shorter length or vertical cables, such as the tension cables 160 of FIG. 4B, could be connected between the cables 5*b* and 6*b* to reduce the tension forces on cables 5*b* or to permit the occasional use of higher air pressures, such as 40 to 70 psf or more.

The central opening 220 of the domed stadium is located directly above the central portion of the rectangular football or soccer field f shown in broken dot-dash lines in FIG. 4C2 and is tapered to admit more sunlight to the playing field, which has a width of around 160 feet and a length at least twice its width. The central tension ring 29 at the top of the dome can have a diameter width of 100 to 150 feet or so in a roof structure of the type shown in FIG. 4CC or a much greater diameter, such as 200 to 250 feet or more in a structure of the type shown in FIG. 4B. If the diameter is more than 150 feet, a removable cover or lid C' of the type shown in FIG. 4B may be more appropriate than a rigid reticulate frame or cover, such as the cover C' of FIG. 4CC. Of course, a removable lid C could be employed in the latter embodiment even if the diameter of the ring 29 is 100 feet or less.

The specific roof structure illustrated in FIG. 4CC with a tension ring 29 having a diameter of only 100 to 120 feet or so is advantageous because it permits use of a rigid reticulate cover C' of relatively light weight, such as a geodesic-type dome or other metal structure that can be triangulated for added strength. Such a rigid cover can be provided with a large number of shapely windows or window-like openings that can be left open but are preferably closed or covered by clear or semitransparent panes or panels formed of glass or a suitable synthetic plastic material that transmits sunlight to the playing field f. The top of the opening 220 at the ring 29 could also be covered by an open network or screen that can be uncovered during sports events and covered with a clear plastic material at other times.

As shown herein, the reticulate metal cover C' is convex and shaped like a circular dome. It has a series of regularly-spaced arched radial frame members defining a series of generally trapezoidal windows. The metal frame or cover C' can be employed in a convertible open-air stadium where the central roof opening can be closed to permit air conditioning or heating or opened, when desired, before a sports event. The window openings of the reticulate cover C' can be closed or covered with clear or semitransparent panes or panels. The window panels can be designed to move from closed to open positions or can be removed in various ways.

FIG. 4C is a crude schematic elevational view showing another modified form of my invention wherein a multitude of upright rigid struts or posts 101 to 104 are employed to provide an elevated convex domed ceiling ll*c*. This embodiment of the invention is similar to that of FIG. 4AA, 4BB or 4CC in that the radial tension cables 5*c* and 6*c* are evenly spaced as in FIG. 2 and the ceiling (11*c*) is raised by successive circular rows of upright rigid posts or struts that are suspended by steel cables.

In the preferred embodiment of FIG. 4AA, each row of struts is carried by a large circular tension ring. A separate tension ring (4) may in like manner be employed in FIG. 4C to support each of the four rows of struts 101 to 104, but four concentric rings are not essential. Other means may be employed to hold the struts in the desired position as disclosed, for example, in Berger U.S. Pat. No. 4,757,650 where bracing cables provide a system of triangles to hold the struts in fixed positions. optionally similar bracing cables can be employed in the embodiment of FIG. 4C, some of which are indicated at 200.

FIG. 4C is a schematic view representing the structure at each of the 40 or more radial vertical planes containing the cables 5*c* and 6*c* and the associated rigid struts 101 to 104. The roof structure in this embodiment is similar to or comparable to that of previously described embodiments and includes an outer compression ring 3, lower and upper connecting rings 107 and 108 separated by a cylindrical row of twenty to forty or more rigid struts 70, and evenly spaced upper and lower radial cables 5*c* and 6*c* extending between the outer ring 3 and the inner rings. The ceiling cables 6*c* are supported by the rigid struts 101 to 104 to provide a dome-shaped ceiling 11*c* that supports the lower fabric membrane 8*c* of an inflatable bladder means 2*c* that covers the entire ceiling. The upper membrane 9*c* engages the upper cables 5*c* (as in FIG. 1A) and covers the closed air space 120 defined by the bladder means 2*c*.

The lower ends of the rigid struts 101 to 104 at 4*a*, 4*b*, 4*c* and 4*d* are supported from ring 3 or cable 6*c* by short cables 201 to 204, respectively, and the upper ends engage or support the cable 6*c* to provide a raised ceiling with the desired dome shape. The inner portion 106 of each ceiling cable 6*c* sags between the upper end 105 of each strut 104 and the tension ring 107 while supporting the struts 70 and the upper ends of the hold-down cables 5*c*.

As shown one of the bracing cables 200 extends between upper end 105 of strut 104 and the lower end of strut 103.

Such bracing cables are not needed when the struts are supported on four large concentric tension rings 4*a* to 4*d*. Each of these tension rings can have a catwalk as shown for access to lights, for example.

One of the preferred embodiments of the invention is illustrated schematically in FIG. 4AA and is almost the same as the embodiment of FIG. 4A except for the raised radial ceiling cables 60, the inflatable bladder means 2*aa* and its lower fabric membrane 8*aa*.

The dome 10*aa* of FIG. 4AA can be basically the same as the dome 10*a* of FIG. 4A and can have from 40 to 70 evenly spaced radial hold-down cables 5*a* engaging the upper fabric membrane 9*aa* of the bladder means 2*aa* substantially in the manner shown in FIG. 1A. The cables 5*a* extend from the outer compression ring 3 to the upper tension ring $7^a$ of a vertical spreader means 70 comparable to or essentially the same as the spreader means of FIG. 4. The raised ceiling 11*aa* is formed by 40 to 90 evenly spaced radial suspension cables 60 connected between the outer ring 3 and the intermediate tension ring $7^c$ of the spreader means 70 and engaging the lower surface of the fabric membrane 8*aa* of the bladder means which can also be connected to the ring 3 (as in FIG. 9A). The bladder means provides a closed air space $120^a$ with a diameter almost the same as that of the air chamber 12' but of much less volume.

The ceiling 11*aa* is supported by. 40 or more short evenly spaced radial suspension cables 26 and an equal number of rigid upright posts or struts 24 that extend between the tension rings 25 and 27 as in FIG. 4A. An equal number of evenly spaced radial suspension cables 6*aa* are connected between the upper tension ring 27 and the lower tension ring $7^b$ of the spreader 70 to support the spreader and the cables 5*a* and 60 connected thereto, whereby the central portion of the ceiling 11*aa* is supported in an elevated position.

Optionally an annular tube 100' can be provided in the bladder means 2*aa* as in the embodiment shown in FIG. 4BB to maintain tension in the cables 5*a* and/or to provide a separate annular air chamber 161' comparable to air compartment 161. The optional tube 100' could be used in the manner more fully described in connection with the embodiment of FIG. 4BB. It could also be omitted or replaced by the optional vertical cables 160 as in FIG. 4B.

The embodiment of schematic FIG. 4AA and the mode of operation are described herein in more detail as an example to facilitate an understanding of my invention including other embodiment of FIG. 4. Cable connections and other structures commonly used in stadium roof systems are not described. There are well known and described in various patents including U.S. Pat. Nos. 3,744,191 and 4,345,410. Likewise, the architectural fabric employed in the upper and lower membranes of the inflatable bladder means can be a conventional material including the fabrics disclosed in U.S. Pat. No. 4,452,848 (e. g. , coated woven fiberglass fabric).

Figure 9A:
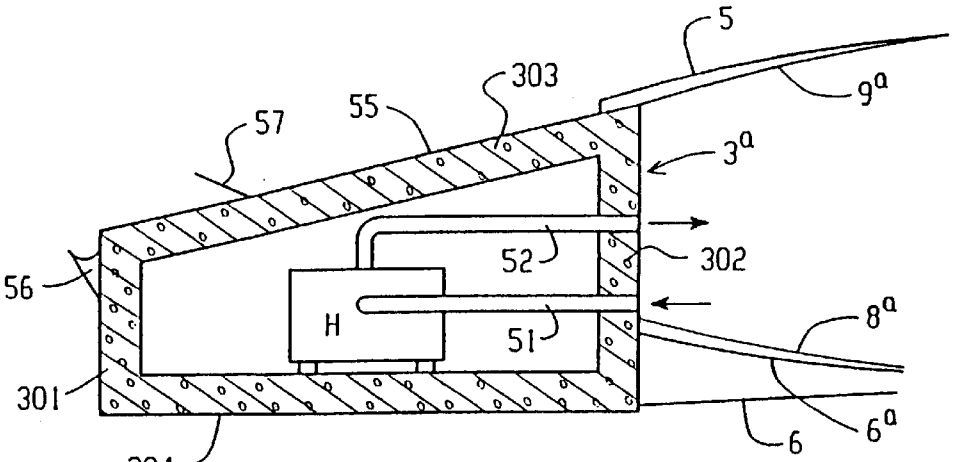
FIG. 9A is a schematic fragmentary sectional view showing that section on a larger scale.
Figure 9:
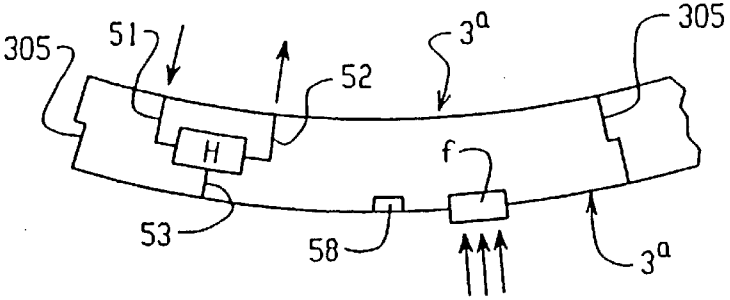
FIG. 9 is a schematic top view showing one section of the huge hollow compression ring containing associated fan and heater means for pressurizing and heating the air.

For example, in carrying out my invention the hollow compression ring 3 may be round or elongated with a diameter or width of 800 or 900 feet and may be a massive sectional reinforced concrete structure with a cross section throughout its perimeter which is generally uniform or comparable to that shown in FIG. 9A with top, bottom and side walls with a thickness of 18 to 24 inches or more. Each curved section $3^a$ of the concrete ring can have a width of from 20 to 30 feet, a height of from 7 to 10 feet or more, and a length of from 90 to 120 feet or more.

Each section $3^a$ or every other section would preferably contain a fuel-fired air heater H with suitable air ducts or conduits 51 and 52 to conduct the air from the bladder means into the heater and direct the heated air into the bladder. When desired, a vent conduit 53 could be provided to exhaust the combustion gases to the outside.

The 70 or more hold-down cables (5) and the upper fabric wall (9) of the dome are preferably supported at the top of the ring 3 and sloped to facilitate removal of rain water, and the upper surface 55 of each section $3^a$ is also sloped to allow rain flow to a peripheral water trough or gutter means 56. A door 57 is provided in the top wall to provide maintenance personnel with ready access to the top of the dome.

Six to thirty or more fans or blowers f are regularly spaced around the periphery of the compression ring to maintain the desired air pressure in the inflatable bladder means. Such fan means can be provided in the ring section $3^a$ as indicated schematically in FIG. 9 to direct air under pressure to the interior of the ring 3 and the bladder means (2 or 2*aa*). A suitable vent means 58 may also be provided to facilitate controlled or rapid reduction in the air pressure when desired. The normal air pressure in the inflatable bladder means of the dome could be from 10 to 15 pounds per square foot (psf) and could be increased to 40 psf or higher when desired.

The air inside the stadium below the dome can be caused to circulate by use of fan means 50 at opposite sides or opposite ends of the stadium as indicated schematically in FIG. 4AA, for example. Such fan means could, for example, provide from 2 to 5 air changes per hour in a stadium with a capacity of 50,000 or more spectators. Likewise the fan means f could provide rapid air changes in the closed air space (12) of the bladder means, when suitable vent means are provided to promote air circulation. Vents or louvers v can be provided for that purpose that open inwardly and are held closed by the internal air pressure. Such vents can be provided at both rings $7^a$ and $7^c$ of the spreader means 70 in the embodiments of FIGS. 4 and 4AA. Such vents can similarly be provided in the embodiments of FIGS. 4A, 4C and 5 as shown. venting of the air in this manner facilitates efficient cooling of the air in the bladder means in hot summer weather and rapid heating of the air to heat the stadium or to melt snow in the winter. The vent means v at or near the top center or the bottom center of the inflatable bladder means can be opened or closed or regulated using a suitable electrical system with control panels inside the huge compression ring 3.

The preferred embodiments of my invention shown in FIGS. 4 and 4AA are advantageous and commercially attractive for large stadium domes. The inflatable bladder means $2^a$ of FIG. 4 and 2*aa* of FIG. 4AA have a narrow lenticular cross section which has superior utility and limits the required volume of pressurized air. In carrying out my invention, it is usually preferable to provide bladder means or similar inflatable means of lenticular cross section where the cross-sectional length is at least 15 to 20 times the average cross-sectional width or height (as in FIGS. 4, 4AA, 4BB and 4C).

The roof structures exemplified by schematic FIGS. 4 and 4AA are particularly well suited for covering wide spans of 850 to 950 feet. For example, when the radial cables are uniformly spaced five degrees apart, the dome can be supported by seventy-two steel (wire-rope) cables 6 (FIG. 4) or seventy-two steel cables 26 (FIG. 4AA) with a diameter of 3½ to 4 inches. The same number of ceiling cables $6^a$ or 60 of that same diameter could be used. The length of each cable 6, $6^a$, and 60 could, for example, be 420 to 460 feet. The steel hold-down cables 5 (FIG. 4) and 5*a* (FIGS. 4A and 4AA) would be at least as long and could be of comparable size and strength, but the diameter could be substantially less (e. g. , 2 to 3 inches) depending on the internal air pressure believed necessary for a particular application. An air pressure of 5 to 10 psf may be adequate in localities where windstorms do not pose a problem.

In the embodiments of FIGS. 4 and 4AA the rigid vertically elongated spreader means 70 at the center of the dome has three annular rings $7^a$, $7^b$, and $7^c$ connected to a large number of evenly spaced parallel posts or struts 20 arranged in a circle to provide an open-type cylinder. In a typical large stadium dome, said rings could have a diameter of 20 to 40 feet, for example, and the struts 20*a* and 20*b* of the spreader means 70 could be vertical steel tubes with a diameter of about 4 inches. When using radial cables spaced five degrees apart, thirty-six tubes 20*a* could be connected between the rings $7^a$ and $7^c$ and seventy-two tubes 20*b* could be connected between the rings $7^b$ and $7^c$.

Each of the fabric membranes $8^a$ and $9^a$ (FIG. 4) or 8*aa* and 9*aa* (FIG. 4AA) would have a central circular opening to receive the spreader means 70 and reinforced by a rigid metal ring ($7^a$ or $7^c$) that fits the struts 20*a*. Such a reinforcing ring would maintain the desired tension in the fabric membrane and could be mounted to slide vertically on the struts 20*a* as described hereinafter.

The upper and lower ends of the spreader means 70 would be closed and sealed to prevent escape of air from the closed chamber $12^a$ or $120^a$ of the inflatable bladder means. Glass or clear plastic panels or framed windows could be employed for this purpose, to enhance light transmission, and to improve the appearance of the dome (See the covers 170 of FIG. 4D).

In the examples described above, the dome $10^a$ or 10*aa* could employ a conventional coated woven glass-fiber fabric, such as Birdair's 30-year SHEERFILL fabric, with a thickness of at least one-sixteenth inch or other fabric similar to that used on Atlanta's Georgia Dome. Both the lower and upper membranes $8^a$ and $9^a$ or 8*aa* and 9*aa* of the bladder means can be made of the same high-strength fabric.

The domes of FIGS. 4 and 4AA are designed to provide remarkable resistance to storm damage even in hurricane-like conditions. In the unlikely event of a large tear in the dome fabric, means are preferably provided to prevent dangerous accumulations of water and to facilitate rapid water removal. As shown schematically in FIGS. 1, 2, and 4, a large number of evenly spaced drain plugs d or d' are provided in the top and bottom fabric walls or membranes of the inflatable bladder means. Drain plugs of this type can be employed in all of the disclosed embodiments of my invention to minimize the risk of excessive pooling of water if the bladder means is deflated.

Figure 2A:
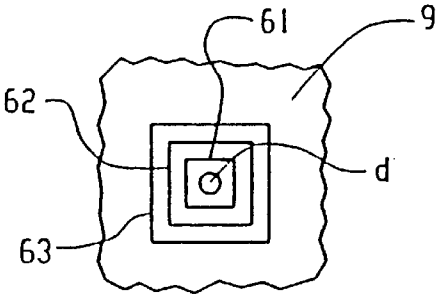
FIG. 2A is a schematic fragmentary top view showing a portion of the dome fabric with a series of square reinforcing patches associated with a removable drain plug.
Figure 2:
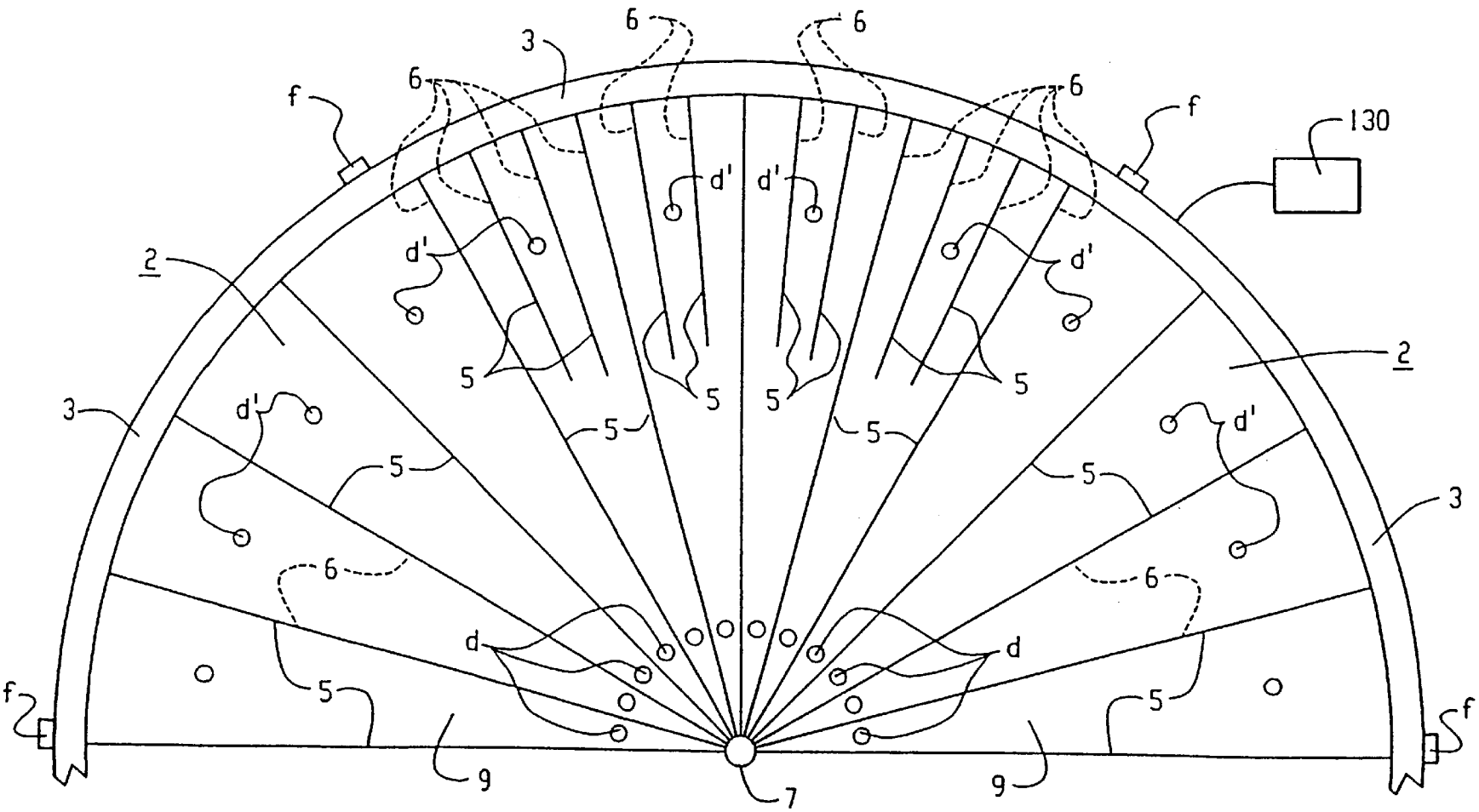
FIG. 2 is a schematic fragmentary top plan view of the equipment shown in FIG. 1 including the oblate inflated bag or envelope, the containment cables and the compression ring.

As shown in FIG. 2A the fabric wall or membrane 9 of the bladder means 2 can be reinforced around each drain plug d (or d') by several layers of fiberglass fabric in the form of different size square patches 61, 62 and 63. The plug would close and seal the associated drain opening and be held closed by the internal air pressure. In emergencies each plug could be opened rapidly by moving it inwardly, for example, by pulling a wire cable controlled manually or automatically from inside the ring 3.

The optimum or preferred locations for the drain plugs depends on the type of roof and the shape of the inflatable bladder means. In the embodiments of FIGS. 2 and 4A, the drain plugs d' are preferably located near the center portion of the dome. In the embodiments of FIGS. 4, 4AA, 4BB and 4C, the drain plugs d could be located closer to the outer ring 3.

If the domed roof structures of the present invention are to be used in locations where hurricanes or wind storms pose a serious problem, it may be desirable to increase the size and strength and/or the number of radial hold-down cables in the dome so that a greater air pressure can be provided in the bladder means during periods of emergency. For example, the spacing between said radial cables can be reduced from 5 to 4 degrees or the diameter of the cables can be increased to 3 or 4 inches.

Optionally, vertical tension cables could be connected between the upper hold-down cables and the ceiling cables supporting the bladder means to limit upward expansion and thereby reduce the tension in the hold-down cables. This option is indicated schematically in FIG. 4B wherein forty to seventy or more vertical cables 160 extend between the ceiling cables and the hold-down cables of the dome. Similar means may, of course, be employed as a viable option in other embodiments of my invention, such as those illustrated in FIGS. 4, 4AA and 4C. It thus becomes possible to increase the air pressure in the bladder means extremely when the dome is subjected to dangerous winds or wind gusts of hurricane strength (e.g. , an increase to 50 to 70 psf or more).

Figure 10:
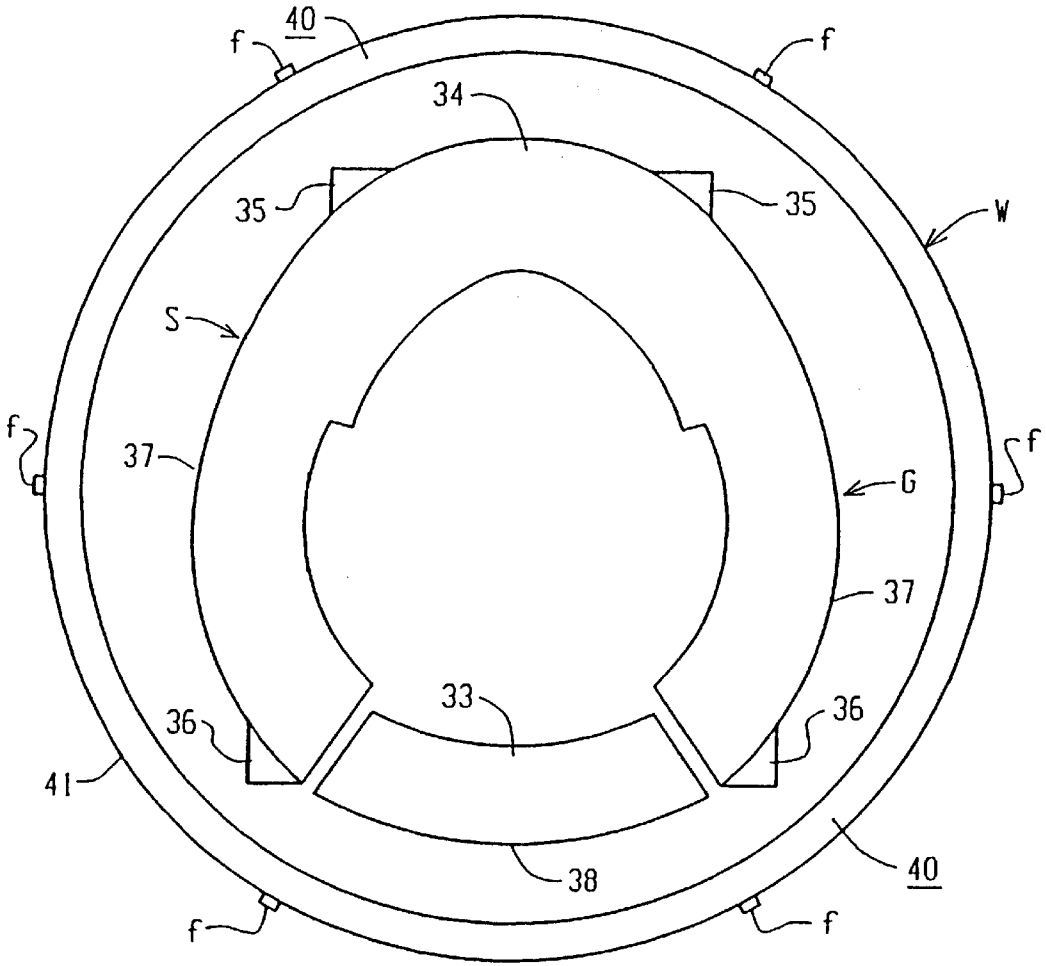
FIG. 10 is a top plan view on a reduced scale showing a combination sports complex and convention center that can be covered the dome of FIGS. 1 and 2.
Figure 11:
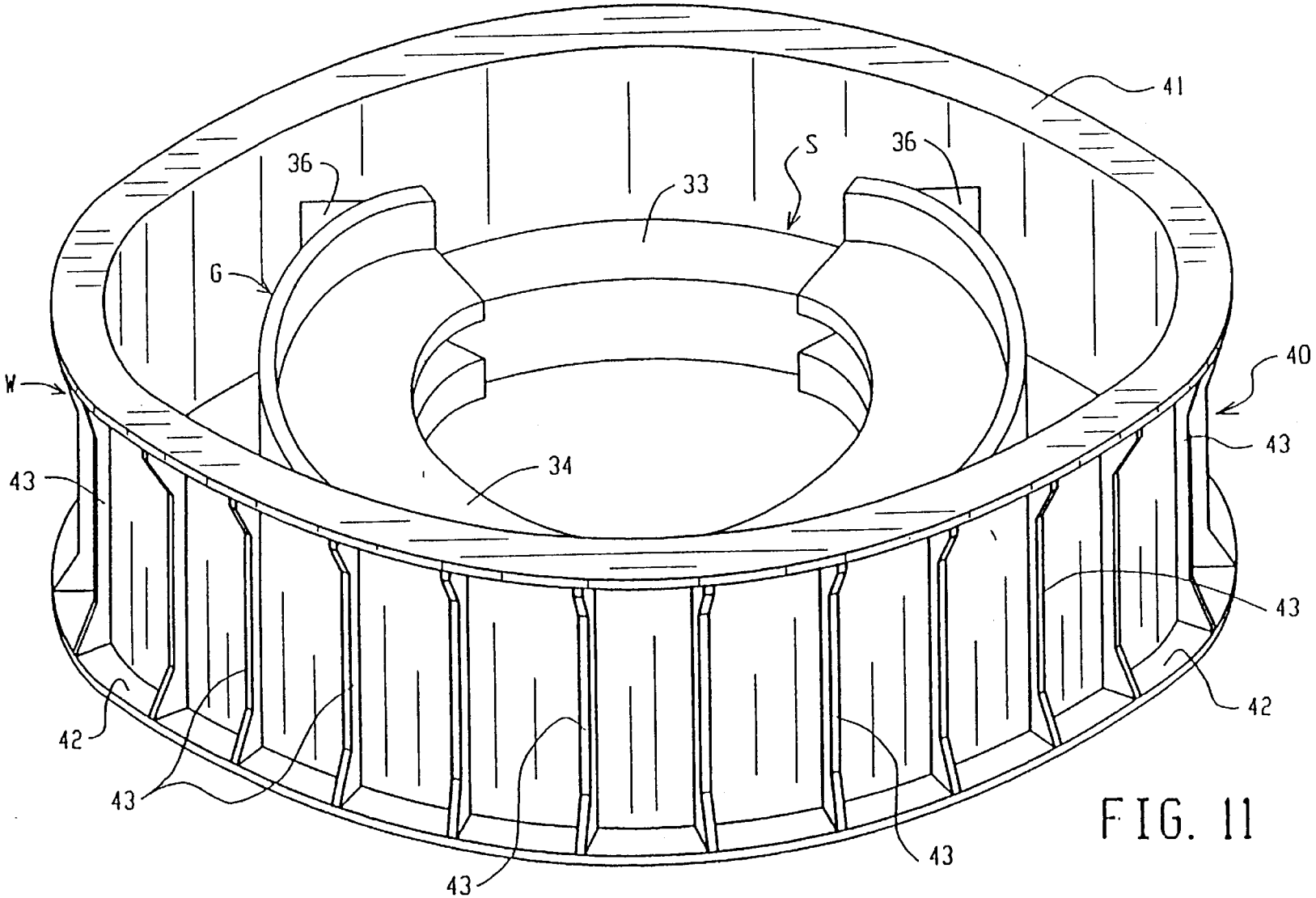
FIG. 11 is a perspective view on a reduced scale showing a scale model of the combination illustrated in FIG. 10.

One of the preferred embodiments of the present invention is illustrated in FIGS. 10 and 11 and relates to a proposed renovation of Cleveland Municipal Stadium, one of the larger baseball stadiums. That stadium (S) is drawn to scale in the top view of FIG. 10 and includes U-shaped grandstands G which extend around the natural grass playing field and terminate at the center field bleacher section 33. The grandstands include a rounded portion 34 near home plate and the baseball infield, squared corner portions or buildings 35 at opposite sides of portion 34, and similar corner portions 36 at opposite sides of the bleacher grandstand 33. The building structures 35 and 36 project outwardly from the outer periphery of the stadium S as defined by the outer walls 37 and 38 of the grandstand G and the bleacher section 33, respectively.

The proposed renovation involves removal of the old roof above the upper deck of the stadium S and the associated supporting structure and construction of a huge circular perimeter wall W with a diameter of at least 900 feet that is spaced radially from the outer walls 37 and 38 of the stadium a distance of from 30 to 80 feet and that encloses an area of many acres.

FIG. 11 shows a scale model of the proposed structure with the compression ring 3 and associated cables, such as cables 5 and 6, and other parts of the dome omitted. The stadium S of the model was carefully prepared and is substantially to scale, the old stadium roof being removed. The wall W of the model has a vertical height greater than that of the stadium S and comprises evenly spaced columns 43. In the model these columns extend between flat annular top and bottom rings 41 and 42.

In the proposed structure to be constructed, the perimeter wall W may have a vertical height from 40 to 80 feet greater than the height of the renovated stadium S. The wall may, for example, be 12 to 18 stories high so that it is eventually possible to provide 1 to 2 million square feet of future usable floor space around the existing stadium even when the average radial width of the space between the peripheral stadium walls 37–38 and the perimeter wall W is only 60 to 70 feet or so.

The model illustrated in FIG. 11 does not show details of the massive compression ring 3 (which would replace the upper ring 4) and does not show the box-beam ring sections $3^a$ or the end-to-end arrangement of FIG. 9. A structure of the type would probably employ massive hollow reinforced concrete columns 43 with a height of 90 feet or more capable of supporting hundreds of tons. These could be spaced 40 to 50 feet apart to support hollow concrete box beams $3^a$ weighing 200 to 300 tons or more and having a length corresponding to the center-to-center distance between the columns 43 so that the ends of the box beams are directly above and supported by the columns 43.

The box beam $3^a$ could be prefabricated at the site and formed of prestressed steel-reinforced concrete. It could have a cross section generally as indicated in FIG. 9A with side walls 301 and 302 having a thickness of 20 to 30 inches and top and bottom walls 303 and 304 having less thickness, such as 10 to 18 inches. The opposite ends of the beam $3^a$ can be notched at 305 to fit the adjacent beams. Each section $3^a$ could have a length of from 40 to 50 feet and would provide a large room for a variety of activities having a width of 20 to 30 feet and a substantial height (e. g. , an average height of at least 8 feet).

The ring 3 and its sections $3^a$ are preferably located substantially in a plane that is almost horizontal and usually slanted or sloped a few degrees. The resistance to wind loads can sometimes be improved by providing a slope of 3 to 6 degrees, depending on the location of the domed facility and the likely direction of the wind.

The wind resistance can also be improved by temporarily increasing the air pressure in the bladder means 50 to 300 percent from. the pressure normally used. If, for example, the bladder means has separate compartments, (e. g. , See tube 100 of FIG. 4AA or FIG. 4BB), a portion of the bladder means could be provided with air at a substantial pressure of 30 to 70 pounds per square foot or more.

The air pressure appropriate for or recommended for an inflatable domed roof made in accordance with my invention depends on the diameter or strength of the radial cables employed, the number of cables used, and the diameter or span of the dome.

The normal air pressure maintained in the inflatable bladder means would be less. For example, a very large dome made in accordance with the invention and designed to tolerate and withstand a maximum pressure of 40 psf or more may normally employ an inflation pressure of from 10 to 20 psf, and the fan means f of FIGS. 2 and 9 may be designed for and used to increase that pressure at least 50 percent in a short period of 20 to 30 minutes during a dangerous windstorm.

If greater resistance to wind loads is necessary because of high risks associated with the particular location of the domed stadium, other means may be added to or incorporated in the roof structure. For example, special improved reinforced fabrics and special hold-down means can be used for this purpose. A removable vertical mast 21 of the type shown in FIG. 4A can be used to provide a greater factor of safety.

Figure 4D:
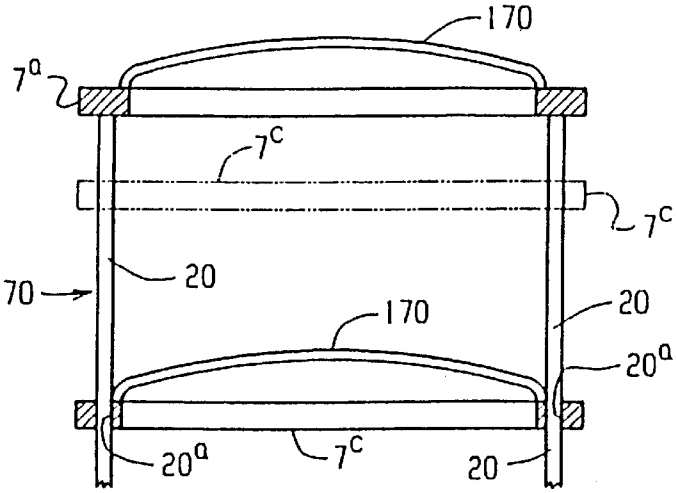
FIG. 4D is a schematic elevational view of the spreader.
Figure 5A:
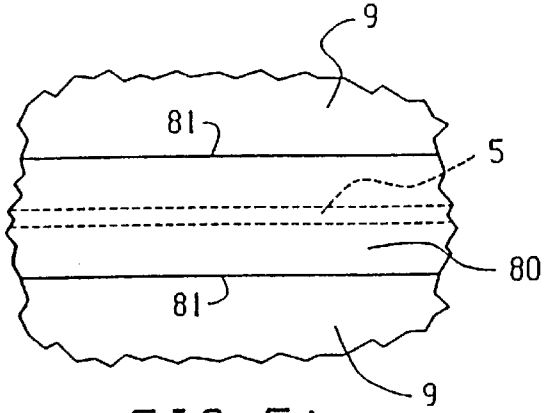
Figure 9B:
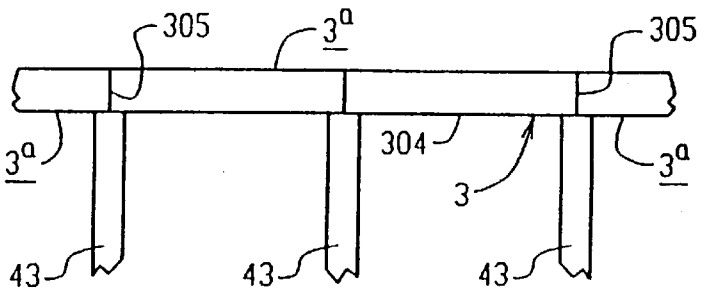
FIG. 9B is a schematic fragmentary elevational view.

FIGS. 5A and 5B show a modified form wherein each cable 5 is positioned on the fiberglass fabric membrane 9 midway between the straight parallel edges 81 of a fabric strip 80. The strip 80 is preferably formed of the same fiberglass fabric as membrane 9 and is securely adhered and attached to said membrane. A strong connection between the membrane 9 and the strip is provided along the full length of the strip, which can extend 400 feet or more and usually extends almost the full length of the associated hold-down cable 5. This arrangement holds each cable 5 in place relative to the membrane 9, prevents separation in the event the bladder means is deflated, and is particularly useful when the roof structure employs the special spreader means 70 of FIG. 4D.

The strip 80 assumes a normal curved cross section throughout its length generally as indicated in FIG. 5B and forms a groove or trough over the cable 5 to direct water off the dome.

Figure 4E:
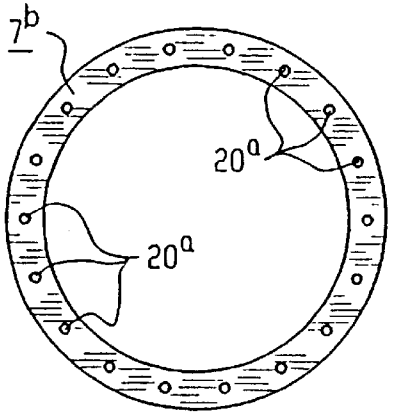
FIG. 4E a top view showing one of the tension rings of the spreader.

FIGS. 4D and 4E are schematic views showing a unique central spreader means 70 which can be used in the practice of the invention in the embodiments of FIGS. 4 and 5 and in other embodiments as an important safety feature in the event the dome is deflated as the result of storm damage. Such spreader means is shown in schematic FIG. 4, for example, as having parallel upper, intermediate and lower tension rings $7^a$, $7^b$ and $7^c$ in vertical alignment, the intermediate ring being connected to the fabric membrane $8^a$ and the ceiling cables $6^a$ to hold the central part of the ceiling $11^a$ in an elevated position so that the closed annular air space $12^a$ has a narrow lenticular cross section.

If desired, these tension rings can have a diameter of 30 to 40 feet and provide a central opening to admit air or sunlight. If the central opening is left open, the space between the membrane $8^a$ and $9^a$ would, of course, be closed or sealed, as by a cylindrical wall or sheath extending between the rings $7^a$ and $7^c$. In the embodiment of FIG. 4D, such central opening is closed by dome-shaped covers 170.

In that embodiment each of the tension rings, $7^a$, $7^b$ and $7^c$ could be a heavy steel annulus with a series of regularly spaced cylindrical holes $20^a$ as shown in FIG. 4E, preferably 20 to 50 or more holes of a size to fit the tubular vertical struts 20 carried by ring $7^b$. The normal fixed positions of the tension rings $7^a$ and $7^c$ when the bladder means $2^a$ is fully inflated are shown in solid lines in schematic FIG. 4D, and a raised position of ring $7^c$ is shown in broken lines in that figure. The circular covers 170 mounted on the rings can be dome-shaped and can, for example, employ a rigid network for framing a large number of window panes or panels.

As will be apparent from FIG. 4, all of the 70 or more hold-down cables 5 and the radially inner portions of the upper fabric membrane $9^a$ are connected to the upper tension ring $7^a$. Likewise, all of the ceiling cables $6^a$ a and the radially inner portions of the lower fabric membrane $8^a$ are connected to ring $7^c$. These glass-fiber membranes are attached to the compression ring 3 and the tension rings $7^a$ and $7^c$ (and optionally to the end portions of cable 5 and $6^a$) so that the membranes are held taut when the bladder means is in its normal inflated position. The attaching means used for this purpose can be of various types including the clamping means disclosed in U.S. Pat. Nos. 4,345,410 and 4,559,746.

The cables 5 and $6^a$ can have a length of 400 feet or more and preferably have substantially the same length. The length of each ceiling cable $6^a$ can be such as to permit raising of the tension ring $7^c$ to a position near or almost in engagement with the ring $7^a$ or such as to cause a desirable increase in tension when that ring is raised to the uppermost position.

In accordance with the invention, at least one of the tension rings $7^a$ and $7^c$ of the spreader means 70 is mounted for vertical sliding movement on the tubular vertical struts 20 so that the two rings can be allowed or caused to move together when the inflatable bladder means $2^a$ is deflated. As shown in FIG. 4D, the upper tension ring $7^a$ is fixed at the top of the spreader means 70 and the lower ring $7^c$ is mounted on the tubes 20 for vertical sliding movement. Suitable motor-operated screw means or hydraulic lifting means may be employed to raise the ring to and above the position shown in broken lines in FIG. 4D.

The method of the present invention, carried out when the bladder means is deflated or unable to hold air under pressure, is to cause relative vertical movement between the rings $7^a$ and $7^c$ so that they come together and to cause the sagging cables 5 and $6^a$ and the membranes $8^a$ and $9^a$ to have the same or generally the same shape, curvature and configuration and to remain taut or assume desirable positions in which the cables 5 and $6^a$ reinforce each other or serve as suspension cables and in which both membranes are sloped to facilitate rapid removal of water through suitable drain openings, such as those indicated at d' in FIGS. 1 and 2. This method can prevent dangerous pooling of rain water resulting from stormy weather in the event that the dome fabric is torn or seriously damaged. Recent experience in Atlanta's Georgia Dome indicated that such pooling of water can be catastrophic.

The special spreader means 70 of FIG. 4D as described above (with movable lower tension ring $7^c$ that can be raised at any time by hydraulic means) makes it possible to carry out the above-described method in a simple manner. This safety feature can be very important especially for domed stadiums in localities where snow and wind storms pose serious problems.

It will-be understood that the unique combination of the present invention with an inflatable bladder means for supporting the dome includes means for supporting central portions of the bladder so that it has a narrow cross section and provides an annular pressurized air space of narrow lenticular cross section between the upper hold-down cables and the ceiling cables. In this combination the means for supporting the bladder and the ceiling cables or associated central spreader means (70) can be overhead suspension cables, such as those employed in the Alamodome (San Antonio), or a huge structural steel arch above the dome, or suspension cables carried by the outer compression ring 3 below the ceiling as in FIG. 4, for example.

If the spreader means (e. g. , means 70) at the center of the dome is not located above or near an athletic playing field or a sports stadium, it can be supported by a permanent vertical post comparable to the temporary mast 21 of FIG. 4A. Likewise, the present invention contemplates building complexes with multiacre domes supported at the center by a tower or tall building and having 90 or more radial tension cables with a length of 400 to 600 feet or more.

In domed baseball or football stadiums constructed in accordance with the invention, the playing fields would normally be covered with artificial turf that could be covered temporarily with six-inches of natural grass before a football or soccer game as will be done this year in the Alamodome and was done in the Pontiac Silverdome for World Cup soccer games using more than 1000 interfitting hexagonal metal pallets to carry the sod. This patented pallet system is being used commercially (Three Dimensional Services) and provides a superior natural grass playing field. It is obviously less costly than growing and maintaining grass in an open-top football-only stadium used for only 10 to 12 football games per year.

A natural grass playing field is not needed for baseball and is not necessarily important for football. Improved types of artificial turf, such as PAT, are often preferred for both football and baseball, even in open-air stadiums, such as Joe Robbie Stadium in Miami and Three Rivers Stadium in Pittsburgh. In Los Angeles, the natural grass playing field of Dodger Stadium was recently ripped out and replaced by PAT artificial turf. At present most football players prefer to play on natural grass, but that may not be true in the near future due to improvements in artificial turf technology and improvements in cleated athletic shoes. In any event, a multipurpose domed sports stadium is desirable and appropriate in any part of the country whether or not there is a preference for natural grass turf.

Roof structures of the type shown in FIGS. 1, 2, 4, 4A, 4AA, 4C and 5 usually employ inflatable bladder means formed of high-strength woven-fabric architectural membranes, such as SHEERFILL, made by Chemfab Corp. of New Hampshire, or other coated glass fiber fabric. Teflon-coated fiberglass offers the advantage of translucency and the concurrent advantage of high reflectance. Also internal lighting is efficient due to the high reflectivity of the fabric.

It will be understood that the specific embodiment of the invention shown in the drawings and described herein is presented to illustrate basic principles of the invention and is not intended to limit the scope of the invention. Modifications and various improvements of the specific methods, uses and devices disclosed herein will be apparent and are within the spirit of the invention.

I claim:

1. A roof structure for covering a sports dome with a clear span of at least about 500 feet, peripheral compression means surrounding the dome, ceiling cable means connected to said compression means to form a suspended ceiling below the dome, central connecting means near the upper portions of the done, a series of closely and evenly spaced radial hold-down cables connected to and extending between said central connecting means and said compression means, inflatable bladder means covering said ceiling and providing a closed pressurized air space between said central connecting means and said compression means, inflatable bladder means covering said ceiling and providing a closed pressurized air space between said hold-down cables and said ceiling, blowe means supplying air to said air space to maintain tension in said hold-down cables, said bladder means having an upper fabric membrane at the outer surface of the dome, and means for limiting the vertical separation of said ceiling and said central connecting means to limit the volume of air in said air space.

2. A roof structure according to claim 1 wherein said means for limiting the vertical separation comprises upright spreader means connected between said ceiling and said central connecting means.

3. A roof structure according to claim 2 wherein suspension cable means are provided to support said spreader means and elevate the central portion of said ceiling.

4. A roof structure according to claim 2 wherein suspension cables are connected between said spreader means and said compression means, and said spreader means supports the central portion of said bladder mean so that it has a narrow lenticular cross section.

5. A roof structure according to claim wherein said bladder means has upper and lower fabric membranes defining said closed air space, said upper membrane having outer marginal portions connected to said compression means to hold membrane taut, and wherein said radial hold-down cables engage the upper fabric membrane of the dome at regularly-spaced locations while allowing the tensioned membrane to expand the bulge outwardly between adjacent cables.

6. A roof structure according to claim 5 wherein perimeter wall means supports said compression means and is spaced radially from said stadium to increase the acreage covered by the dome and to enclose a multipurpose municipal center.

7. A structure according to claim 1 wherein said dome is located above a sports stadium having an outer wall extending around the periphery, a perimeter wall means is radially spaced from and surrounds said stadium and has a vertical height greater than that of the stadium, said compression means is mounted on said wall means and has a diameter of at least about 800 feet, and a multitude of spaced hold-down cables are connected to said compression means.

8. A roof structure according to claim 1 wherein said ceiling is supported from below in an elevated position by a series of spaced short lower suspension cables connected to said compression means and to a large tension ring and by a series of upright struts connected between said tension ring and the cables of said ceiling.

9. A structure according to claim 1 wherein said dome has a span of from about 800 to 1200 feet and said compression means comprises a large number of hollow reinforced concrete sections arranged end-to-end around the perimeter wall means to define an annular air conduit, each section comprising a prefabricated steel-reinforced concrete box beam with a length of from about 40 to about 50 feet having vertical side walls with a thickness of at least 20 inches and top and bottom walls providing that section with a room with a width of at least 20 feet and an average height of at least about 8 feet.

10. A roof structure according to claim 1 comprising a peripheral compression means supporting a dome, a central spreader having upper and lower tension rings, a series of regularly spaced radial suspension cables of and the lower tension ring to form a suspended ceiling under the dome, a series of radial hold-down cables of the same length connected between said compression means and the upper tension means, and inflatable bladder means coextensive with said ceiling and having upper and lower membranes providing a closed pressurized air space between said hold-down cables and said suspension cables, said membranes being connected to and extending between said compression means and the tension rings of said central spreader and being held taut when the bladder means is inflated, one of said tension rings being mounted on said position adjacent the other tension ring whereby the normally convex upper membrane can assume the same shape and generally fit the lower membrane when the bladder means is deflated.

11. A roof structure according to claim 1 for covering sports stadiums, building complexes and the like including a fabric dome (10) with a clear span of at least 500 feet characterized by peripheral compression means (3) surrounding the dome, central connecting means (7) located near upper portions of the dome, ceiling cable means **(6*a*) connected to and supported by the compression means (3) to form a suspended ceiling (11) under the dome, a multiplicity of spaced radial hold-down cables (5) connected between the central connecting means (7) and the compression means, and inflatable bladder means (2) covering the ceiling and having upper and lower fabric membranes (9 and 8) providing a closed pressurized air space (12) between the hold-down cables (5) and the cable means (6*a*) of the ceiling, blower means (30) supplying air to the air space to expand the upper fabric membrane (9)** against the hold-down cables and to maintain tension in the cables, the means for limiting the vertical separation of the ceiling and the central connecting means to limit the volume of air in the air space.

12. A roof structure for covering sports stadiums, building complexes and the like comprising a peripheral compression means, a fabric dome with a clear span of at least about 500 feet, central connecting means located near the top of the dome, ceiling cable means connected to and supported by said compression means to form a suspended ceiling under the dome, a multiplicity of regularly spaced radial hold-down cables connected between said central connecting means and said compression means, and inflatable bladder means covering said ceiling and having upper and lower fabric membranes providing a closed pressurized air space between said hold-down cables and the suspension cables of said ceiling, said upper fabric membrane being expanded against the hold-down cables to maintain tension in the cables.

13. A roof structure according to claim 12 wherein said suspension cable means comprises a multiplicity of radial tension cables connected to and extending between said central connecting means and said compression means.

14. A roof structure according to claim 12 for covering stadiums or building complexes comprising a compression ring, a central tension ring, a shaped dome with a span of at least 500 feet formed of architectural fabric which is connected to said compression ring around the periphery of the dome and held taut in a predetermined position, inflatable bladder means having marginal portions connected to said ring, ceiling cable means supporting said bladder means and containment cable means liming the expansion of said bladder means and causing it to conform to the shape of said dome, said containment means including a series of closely spaced radial cables connected to said compression ring and said tension ring and located at the convex outer surface of said bladder means, said bladder means providing closed pressurized air space for maintaining tension in said cables.

15. A roof structure according to claim 14 wherein said compression ring has a diameter or width of at least about 600 feet and a central vertical mast provides a fixed rigid support for said tension ring and the central portion of said dome.

16. A roof structure according to claim 14 wherein said inflatable bladder means comprises a series of air bags providing said closed air space with circumferentially spaced pressurized air compartments.

17. A building structure of the character described having a central dome with a span of at least about 800 feet and outer peripheral walls with vertical supports, a hollow compression ring carried by said supports providing an air conduit extending around the periphery, a series of closely spaced radial hold-down cables extending radially inwardly from said ring toward the central portion of said dome to limit the upward expansion, cable means supporting the dome and forming a ceiling below the dome, inflatable bladder means covering said ceiling and providing closed pressurized air space between the dome and the ceiling that supports the dome with air pressure, and blower means supplying air to said space to maintain an air pressure sufficient to support the dome.

18. A building structure according to claim 17 wherein said bladder means **(2*b*) has a flexible inner wall ($2^w$) defining a central opening encircled by lower and upper tension rings (28 and 29) which are located at the bottom and top of said inner wall and are connected to the ceiling and hold-down cables (6*b* and 5*b*)**, and a cover (C) is mounted on the upper tension ring above said opening.

19. A building structure according to claim 18 wherein the compression ring (3) has a diameter several times that of the lower tension ring (28), the upper tension ring (29) has a diameter substantially less than that of the lower ring, a series of inclined circumferentally-spaced struts **(7*b*) extend between the upper and lower rings and engage the inner wall ($2^w$)**, and the inner wall forms a generally frusto-conical lantern for indirect illumination of the playing field.

20. A roof structure for for covering a sports stadium comprising a dome, and outer compression ring surrounding said dome, central spreader means having an upper connecting ring and a lower connecting ring, a series of evenly spaced radial suspension cables extending between said compression ring and said lower connecting ring to form a ceiling, a series of evenly spaced hold-down cables extending between said connecting ring and said upper connecting ring, inflatable bladder means between said ceiling and said hold-down cables to shape the dome while maintaining tension in said cables, and means for supporting said spreader means.

21. A roof structure according to claim 20 wherein said last-named means includes suspension cables carried by said compression ring below said spreader means, and said spreader means includes rigid upright strut means extending between the ceiling cables and the hold-down cables.

22. A roof structure according to claim 20 wherein said last-named means holds the ceiling in an elevated position in which the inflated bladder means has a narrow crescent-like cross section.

23. A roof structure according to claim 20 wherein said dome has a span of at least about 800 feet, the ceiling cables and hold-down cables provide means for limiting the expansion of the inflated bladder means to provide it with a narrow cross section, and cable means extend downwardly from each radial hold-down cable to the underlying radial ceiling cable to provide means for resisting expansion of said bladder means.

24. A roof structure comprising an outer compression ring, a central connecting means providing a hub means above said ring, a multiplicity of evenly spaced radial hold-down cables connected between said compression ring and said connecting means, a multiplicity of radial suspension cables connected between said compression ring and said connecting means below said hold-down cables, inflatable bladder means below said closed pressurized annular air space between said hold-down cables and said suspension cables to maintain tension in said cables and to form a dome, and means for supporting said central connecting means and the radially inner end portions of said suspension cables above the plane of said compression ring so that said annular air space has a lenticular cross section.

25. A roof structure comprising a dome, an inflatable bladder means supporting said dome and forming a closed pressurized air space, a compression means with a diameter or width of at least 500 feet surrounding said dome, connecting means below the central portion of said dome having upper and lower tension rings, suspension means for supporting said bladder means and said connecting means below said dome, containment cable means shaping and limiting the expansion of said bladder means to provide the pressurized air space with a narrow/enticular cross section, said cable means including a series of spaced ceiling cables supporting said bladder means above said ceiling cables and means compression and a series of spaced radial hold-down cables engaging the outer portions of the dome, said radial cables being connected to said compression means and said tension rings.

26. A roof structure according to claim 25 wherein said suspension means include suspension cables connected between said compression means and said central connecting means.

* * * * *